US010464323B2

(12) United States Patent
Mizuno et al.

(10) Patent No.: US 10,464,323 B2
(45) **Date of Patent: *Nov. 5, 2019**

(54) LIQUID EJECTION HEAD HAVING FLOW PASSAGES

(71) Applicant: BROTHER KOGYO KABUSHIKI KAISHA, Nagoya-shi, Aichi-ken (JP)

(72) Inventors: Taisuke Mizuno, Yokkaichi (JP); Hideki Hayashi, Nagoya (JP); Keita Sugiura, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/035,791

(22) Filed: Jul. 16, 2018

(65) Prior Publication Data

US 2018/0319161 A1 Nov. 8, 2018

Related U.S. Application Data

(63) Continuation of application No. 15/472,077, filed on Mar. 28, 2017, now Pat. No. 10,046,565.

(30) Foreign Application Priority Data

Jun. 30, 2016 (JP) ..... 2016-130333

(51) Int. Cl.
*B41J 2/14* (2006.01)

(52) U.S. Cl.
CPC ..... *B41J 2/1433* (2013.01); *B41J 2/14233* (2013.01); *B41J 2002/14241* (2013.01);
(Continued)

(58) Field of Classification Search
CPC ..... B41J 2/1433; B41J 2/14233; B41J 2/055
See application file for complete search history.

(56) References Cited

U.S. PATENT DOCUMENTS 6,742,883 B1 6/2004 Takata
7,517,058 B2 * 4/2009 Hayakawa et al. ..... 347/63
(Continued)

FOREIGN PATENT DOCUMENTS

EP 2 792 489 A2 10/2014
JP 11-320877 A 11/1999
(Continued)

OTHER PUBLICATIONS

Extended European Search Report issued in related European Application No. 17163945.3, dated Oct. 27, 2017.

*Primary Examiner* — Juanita D Jackson
(74) *Attorney, Agent, or Firm* — Merchant & Gould P.C.

(57) ABSTRACT

A liquid ejection head, including: nozzles; and a supply passage through which a liquid is supplied to the nozzles, wherein the supply passage includes (a) a first flow passage and (b) a second flow passage connected to the first flow passage and including two sections that extend in different directions from a connected position at which the first flow passage is connected to the second flow passage, the liquid being supplied to the second flow passage from the first flow passage, wherein the second flow passage has a liquid flow resistance larger in a first section than in a second section, and wherein a protrusion protruding toward the first flow passage is provided on an inner wall surface of the second flow passage facing the first flow passage, for permitting the liquid to more easily flow from the first flow passage into the first section than the second section.

20 Claims, 10 Drawing Sheets

(52) U.S. Cl.
CPC ..... *B41J 2002/14266* (2013.01); *B41J 2002/14419* (2013.01); *B41J 2002/14459* (2013.01)

(56) References Cited

U.S. PATENT DOCUMENTS

| | | | | |
|---|---|---|---|---|
| 9,044,955 | B2 | 6/2015 | Hirai et al. | |
| 2002/0048477 | A1* | 4/2002 | Udagawa et al. | 400/118.2 |
| 2005/0174387 | A1 | 8/2005 | Ingham et al. | |
| 2014/0313261 | A1 | 10/2014 | Nagai et al. | |
| 2015/0138282 | A1 | 5/2015 | Kobayashi et al. | |
| 2016/0059576 | A1 | 3/2016 | Ito et al. | |

FOREIGN PATENT DOCUMENTS

| | | | |
|---|---|---|---|
| JP | 2008-201069 | A | 9/2008 |
| JP | 2011-746 | A | 1/2011 |
| JP | 2015-36218 | A | 2/2015 |
| JP | 2015-93383 | A | 5/2015 |

* cited by examiner

LIQUID EJECTION HEAD HAVING FLOW PASSAGES

CROSS REFERENCE TO RELATED APPLICATION

This application is a Continuation of U.S. application Ser. No. 15/472,077 filed Mar. 28, 2017, now U.S. Pat. No. 10,046,565, which claims priority from Japanese Patent Application No. 2016-130333, which was filed on Jun. 30, 2016, the disclosures of which are herein incorporated by reference in its entireties.

BACKGROUND

Technical Field

The following disclosure relates to a liquid ejection head configured to eject a liquid.

Description of Related Art

There is known a printer configured to perform printing by ejecting ink from nozzles. An ink-jet head of the known printer includes an ink ejecting portion and an ink supplying portion. The ink ejecting portion includes seven manifolds arranged in a scanning direction such that each manifold extends in a nozzle arrangement direction. The ink supplying portion includes seven first flow passages extending in an up-down direction (including a black-ink inlet portion and opposite end portions of an upstream passage of each of yellow ink, cyan ink, and magenta ink) and seven second flow passages each connected to the corresponding first flow passage and each extending in mutually opposite directions in a conveyance direction (nozzle arrangement direction) from a position connected to the corresponding first flow passage. The second flow passages include a black-ink supply passage and downstream passages for each of yellow ink, cyan ink, and magenta ink. Each second flow passage is connected at its opposite ends in the conveyance direction to the corresponding manifold.

SUMMARY

In the ink-jet head described above, the first flow passages for the ink in respective different colors are shifted relative to one another in the conveyance direction, for preventing interference of the first flow passages in different colors. In this arrangement, the first flow passage for at least a part of the four color ink is connected to the corresponding second flow passage at a position shifted from a central portion of the second flow passage in the conveyance direction. This arrangement inevitably generates a difference in length between two portions of the second flow passage located on opposite sides of the first flow passage in the conveyance direction, namely, a difference in a resistance to flow of the ink flowing therein. Thus, the ink which flows from the first flow passage into the second flow passage is not likely to flow toward one of the two portions in which the resistance to flow is larger, causing a risk that the ink is not sufficiently supplied to the manifold.

An aspect of the disclosure relates to a liquid ejection head which enables a liquid to flow into passages uniformly or evenly in opposite directions.

In one aspect of the disclosure, a liquid ejection head includes: a plurality of nozzles; and a supply passage through which a liquid is supplied to the nozzles, wherein the supply passage includes a first flow passage, and a second flow passage connected to the first flow passage and including two sections that extend in mutually different directions from a connected position at which the first flow passage is connected to the second flow passage, the liquid being supplied to the second flow passage from the first flow passage, wherein the second flow passage has a liquid flow resistance larger in a first section as one of the two sections than in a second section as the other of the two sections, and wherein a protrusion protruding toward the first flow passage is provided on an inner wall surface of the second flow passage facing the first flow passage, for permitting the liquid to more easily flow from the first flow passage into the first section than the second section.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

There will be explained embodiments.

Overall Structure of Printer

Figure 1:
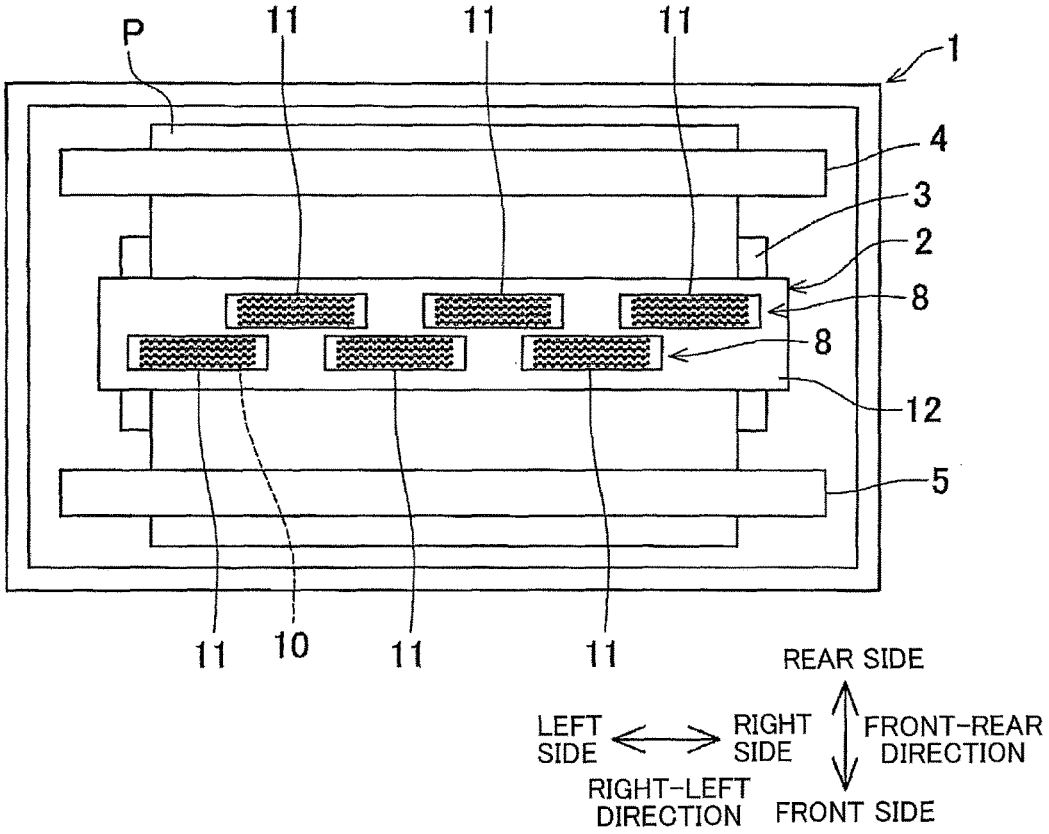
FIG. 1 is a schematic view of a printer 1 according to one embodiment.
Figure 2:
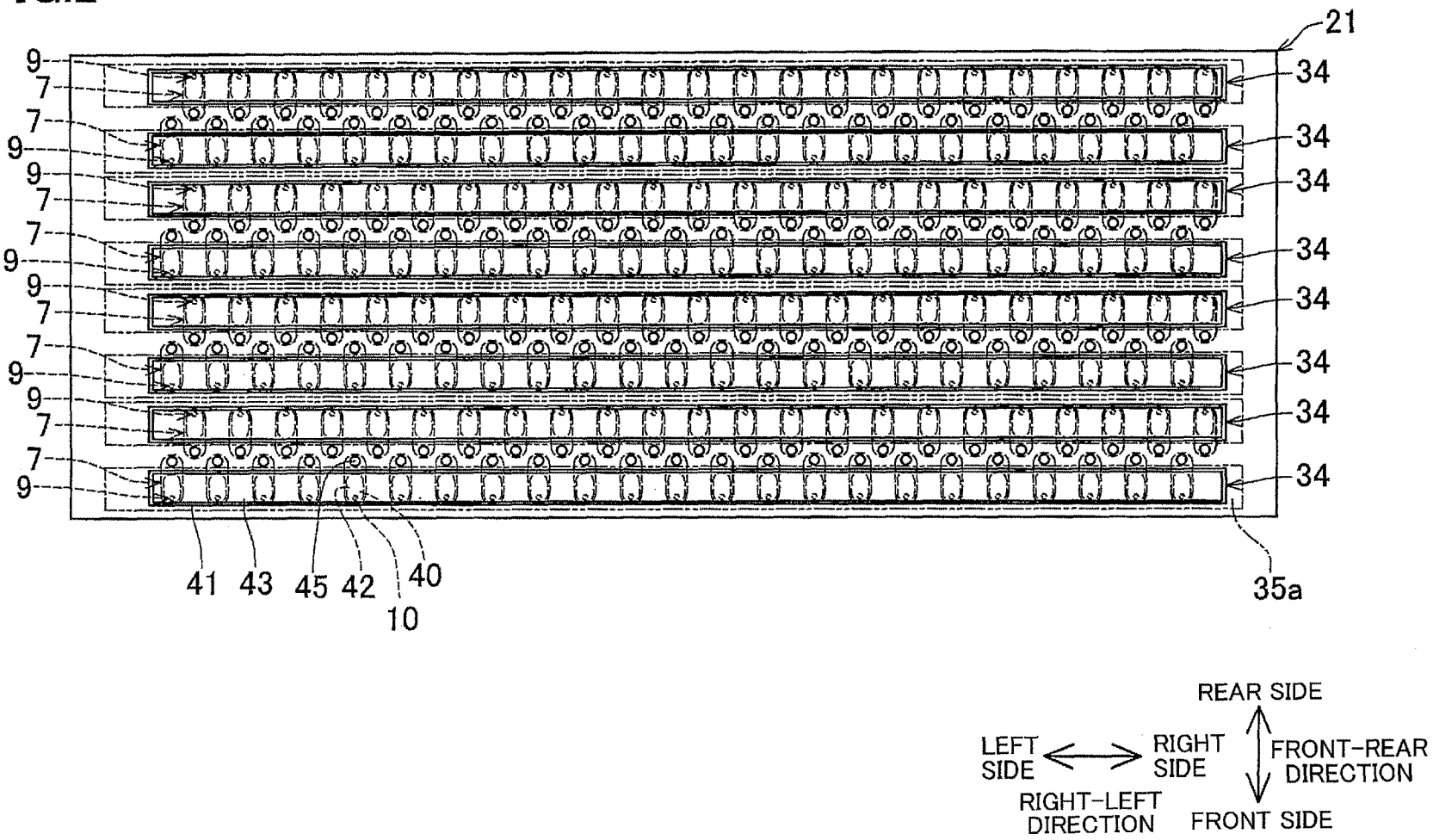
FIG. 2 is a plan view of a head chip 21 of a head unit of FIG. 1.

As shown in FIG. 1, a printer 1 includes an ink-jet head 2 (as one example of "liquid ejection head"), a platen 3, and conveyance rollers 4, 5. As shown in FIG. 1, a direction parallel to a direction in which a recording sheet P is conveyed in the printer 1 is defined as a front-rear direction, and a direction parallel to a conveyance surface of the recording sheet P and perpendicular to the front-rear direction is defined as a right-left direction. Further, as shown in FIG. 1, a front side and a rear side are defined with respect to the front-rear direction, and a right side and a left side are defined with respect to the right-left direction. Each of the front-rear direction and the right-left direction is a horizontal direction orthogonal to the up-down direction.

The ink-jet head 2 is the so-called line head extending over an entire dimension of the recording sheet P in the right-left direction. The ink-jet head 2 includes a plurality of head units 11 and a holder 12. Each head unit 11 is longer in the right-left direction and ejects ink from a plurality of nozzles 10 formed in its lower surface.

The head units 11 are arranged in the right-left direction so as to form a head-unit row 8. The ink-jet head 2 includes two head-unit rows 8 arranged in the front-rear direction. The head units 11 of the front-side head-unit row 8 and the head units 11 of the rear-side head-unit row 8 are shifted relative to each other in the right-left direction. In this arrangement, a left end portion of the head unit 11 in the front-side head-unit row 8 and a right end portion of the head unit 11 in the rear-side head-unit row 8 overlap in the front-rear direction, and a right end portion of the head unit 11 in the front-side head-unit row 8 and a left end portion of the head unit 11 in the rear-side head-unit row 8 overlap in the front-rear direction. The holder 12 extends in the right-left direction so as to hold the plurality of head units 11 in this positional relationship. In the following explanation, "A and B overlap in a direction" means that, when A and B are viewed in the direction, one of: at least a part of A; and at least a part of B is hidden by the other of: at least a part of A; and at least a part of B, or one of: at least a part of A; and at least a part of B and the other of: at least a part of A; and at least a part of B align with each other in the direction. In other words, when A and B are projected onto a plane orthogonal to the direction, at least a part of projective image of A and at least a part of projective image of B exist in the same region.

The platen 3 is disposed below and opposed to the ink-jet head 2. The platen 3 has a dimension in the right-left direction larger than that of the recording sheet P and supports the sheet P from below.

The conveyance roller 4 is disposed on the rear side of the ink-jet head 2 and the platen 3. The conveyance roller 5 is disposed on the front side of the ink-jet head 2 and the platen 3. The conveyance rollers 4, 5 convey the recording sheet P toward the front side.

The printer 1 performs printing on the recording sheet P by ejecting ink from the nozzles 10 of the head units 11 while the recording sheet P is being conveyed toward the front side by the conveyance rollers 4, 5.

Head Unit

The head unit 11 will be explained. As shown in FIGS. 2-6, each head unit 11 includes a head chip 21 and a supply unit 22.

Head Chip

The head chip 21 includes a nozzle plate 31, a flow-passage plate 32, an oscillating film 33, eight piezoelectric actuators 34, and a support plate 35. The nozzle plate 31 is formed of silicon (Si). The nozzles 10 are formed in the nozzle plate 31. The nozzles 10 are arranged in the right-left direction so as to form a nozzle row 9. In the head unit 11, eight nozzle rows 9 are arranged in the front-rear direction. Black ink is ejected from the nozzles 10 of first and second rows 9 from the rear side, yellow ink is ejected from the nozzles 10 of third and fourth rows 9 from the rear side, cyan ink is ejected from the nozzles 10 of fifth and sixth rows 9 from the rear side, and magenta ink is ejected from the nozzles 10 of seventh and eighth rows 9 from the rear side.

The flow-passage plate 32 is formed of silicon (Si) and is disposed on an upper surface of the nozzle plate 31. A plurality of pressure chambers 40 are formed in the flow-passage plate 32. The pressure chambers 40 are respectively provided for the nozzles 10. A rear end of each of the pressure chambers 40 corresponding to the first, third, fifth, and seventh nozzle rows 9 from the rear side overlaps the corresponding nozzle 10 in the up-down direction. A front end of each of the pressure chambers 40 corresponding to the second, fourth, sixth, and eighth nozzle rows 9 from the rear side overlaps the corresponding nozzle 10 in the up-down direction. Thus, the pressure chambers 40 form eight pressure-chamber rows 7 corresponding to the eight nozzle rows 9.

The oscillating film 33 is a film of silicon dioxide (SiO2). The oscillating film 33 is disposed on an upper surface of the flow-passage plate 32 so as to cover the plurality of pressure chambers 40. Circular through-holes 33*a* are formed in the oscillating film 33 at portions thereof each corresponding to one end of each pressure chamber 40 opposite to another end thereof in the front-rear direction at which the nozzle 10 is located.

The eight piezoelectric actuators 34 are provided so as to correspond to the eight pressure-chamber rows 7. Each piezoelectric actuator 34 includes a piezoelectric film 41, a plurality of individual electrodes 42, and a common electrode 43.

The piezoelectric film 41 is formed of a piezoelectric material whose major component is lead zirconate titanate that is a mixed crystal of lead titanate and zirconate titanate. The piezoelectric film 41 is disposed on an upper surface of the oscillating film 33 and extends in the right-left direction across the pressure chambers 40 of the corresponding pressure-chamber row 7.

The individual electrodes 42 are provided for the respective pressure chambers 40. The individual electrodes 42 are disposed on a lower surface of the piezoelectric film 41 so as to overlap the corresponding pressure chambers 40 in the up-down direction. The individual electrodes 42 are connected to a driver IC (not shown) via wirings (not shown). To the individual electrodes 42, there is selectively applied by the driver IC one of a ground potential and a predetermined drive potential (e.g., about 20V).

The common electrode 43 extends over a substantially entire upper surface of the piezoelectric film 41. The common electrode 43 is kept at the ground potential. The individual electrodes 42 and the common electrode 43 are thus disposed, whereby portions of the piezoelectric film 41, each of which is sandwiched between the corresponding individual electrode 42 and the common electrode 43, functions as an active portion that is polarized in its thickness direction.

The piezoelectric actuator 34 additionally includes wirings connected to the electrodes 42, 43 and films for ensuring insulation between the electrodes and the wirings and between the wirings. The additional components are not explained here.

There is explained a method of ejecting ink from the nozzles 10 by driving the piezoelectric actuators 34. In the printer 1, all of the individual electrodes 42 are kept at the ground potential during standby in which printing is not performed. For ejecting ink from one nozzle 10, the potential of the individual electrode 42 corresponding to the nozzle 10 is switched from the ground potential to the drive potential. This generates, in the active portion of the piezoelectric film 41, an electric filed in the thickness direction parallel to the polarization direction, and the active portion contracts in a surface direction orthogonal to the polarization direction. Consequently, portions of the piezoelectric film 41 and the oscillating film 33 overlapping the pressure chamber 40 are deformed as a whole, so as to protrude toward the pressure chamber 40, and the volume of the pressure chamber 40 decreases. As a result, the pressure of the ink in the pressure chamber 40 increases, and the ink is ejected from the nozzle 10 communicating with the pressure chamber 40. Upon completion of the ink ejection from the nozzle 10, the potential of the individual electrode 42 is retuned from the drive potential to the ground voltage, so that the oscillating film 33 and the piezoelectric film 41 return to original states before deformation.

Figure 3A:
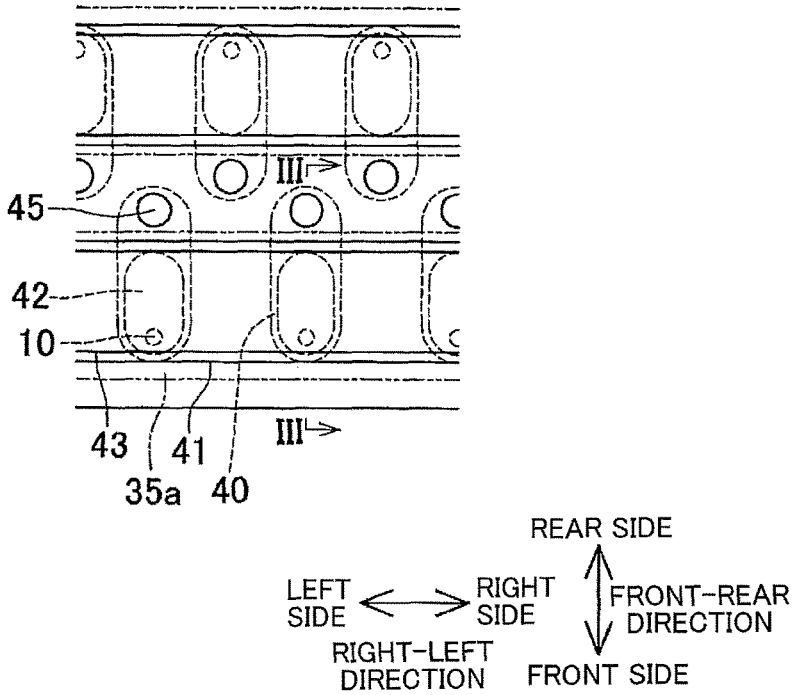
FIG. 3A is an enlarged view of a portion in FIG. 2
Figure 3B:
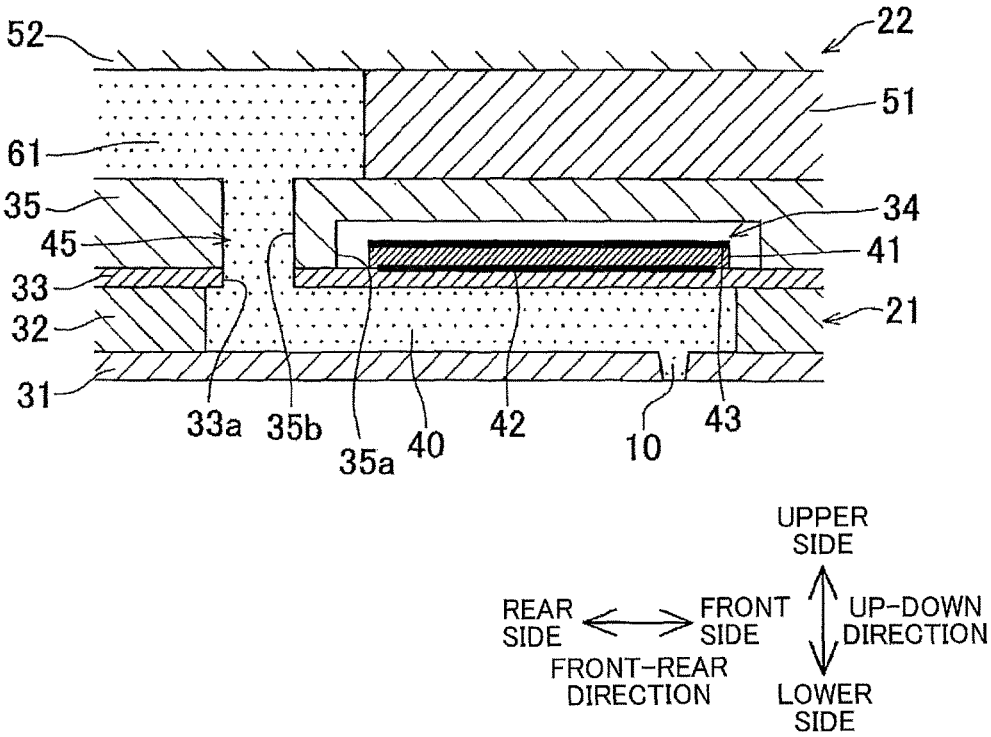
FIG. 3B is a cross-sectional view taken along line III-III in FIG. 3A.
Figure 4A:
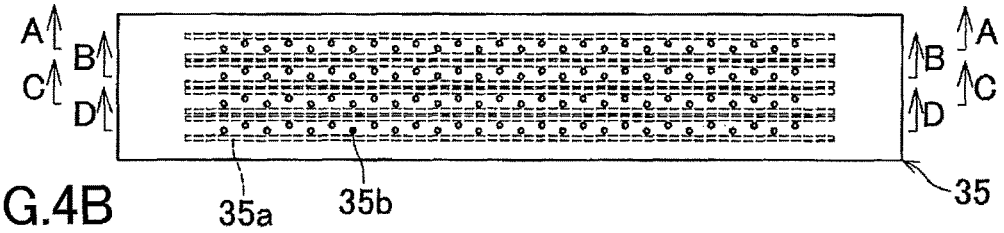
FIG. 4A is a plan view of a support plate 35.
Figure 4B:
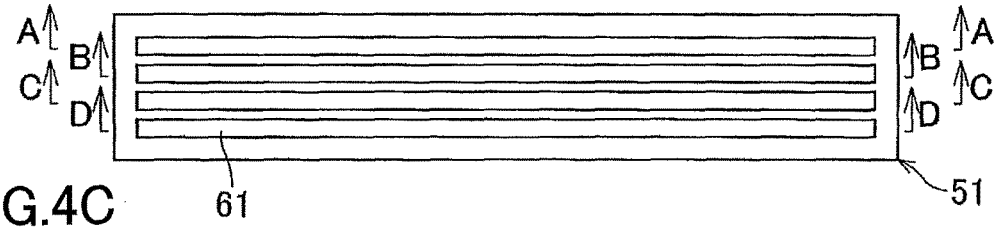
FIG. 4B is a plan view of a plate 51.
Figure 4C:
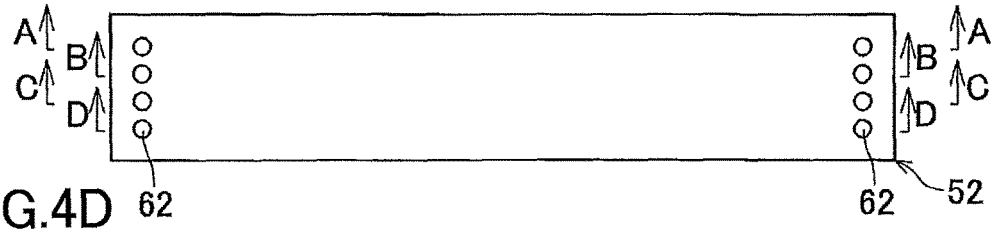
FIG. 4C is a plan view of a plate 52.
Figure 4D:
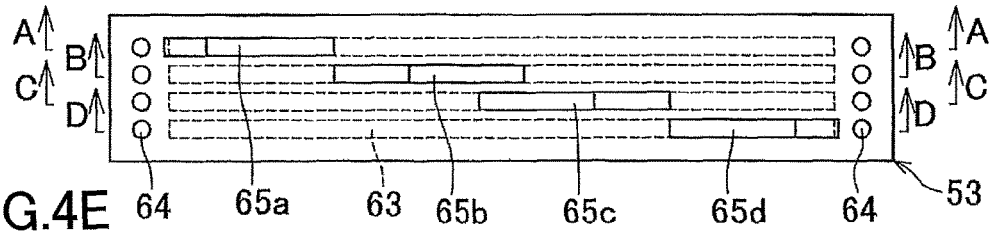
FIG. 4D is a plan view of a plate 53.
Figure 4E:
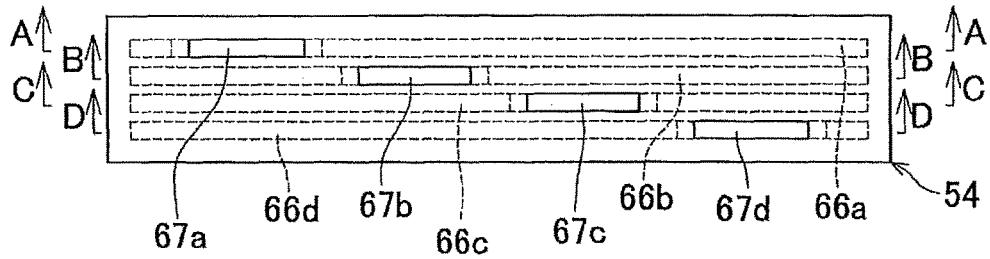
FIG. 4E is a plan view of a plate 54, the plates 51-54 constituting a supply unit 22.
Figure 4E:
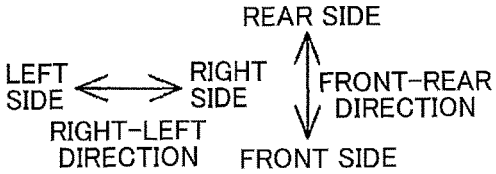
Figure 5A:
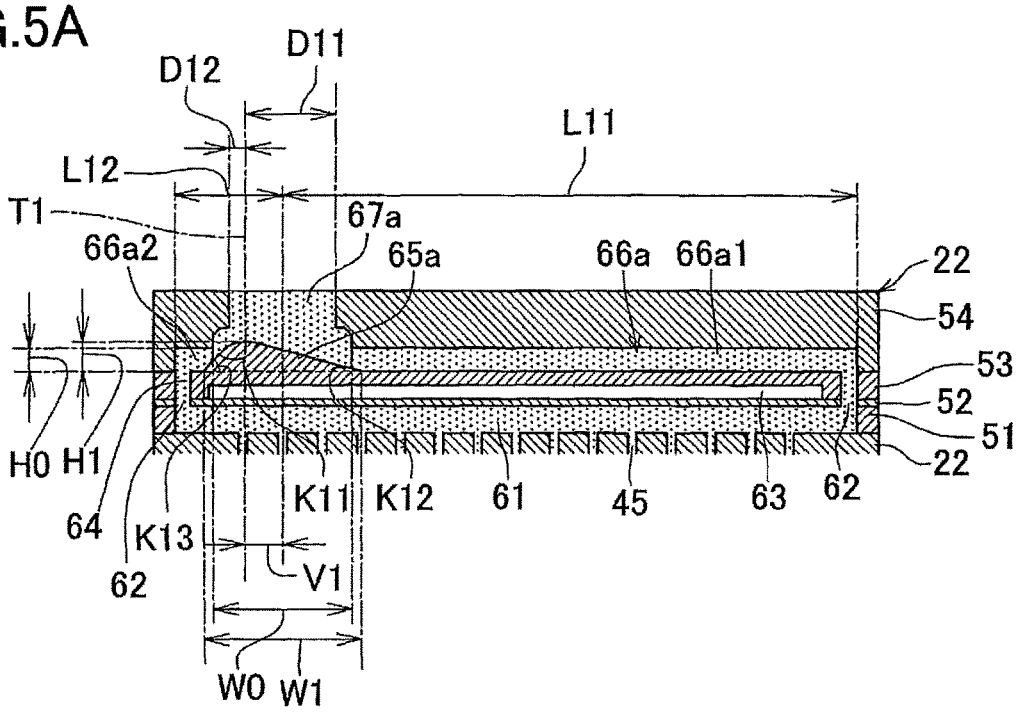
FIG. 5A is a cross-sectional view taken along line A-A in FIGS. 4A-4E and FIG. 5B is a cross-sectional view taken along line B-B in FIGS. 4A-4E.
Figure 5B:
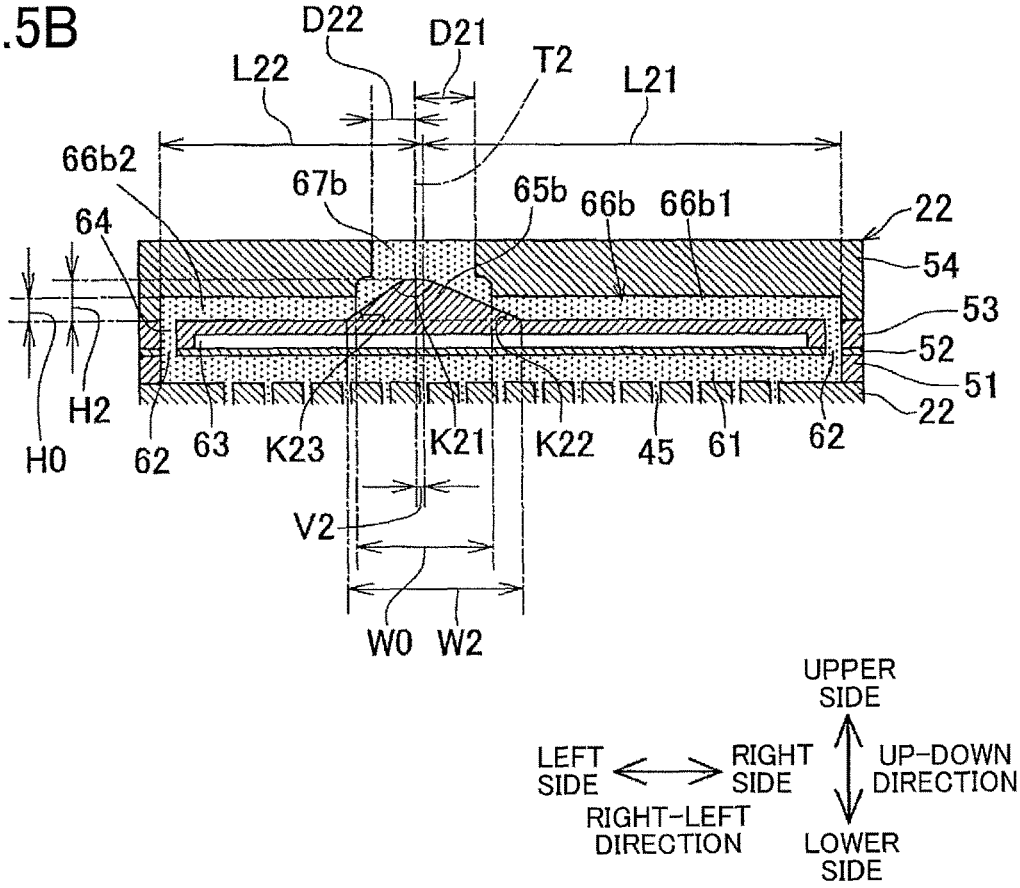
Figure 6A:
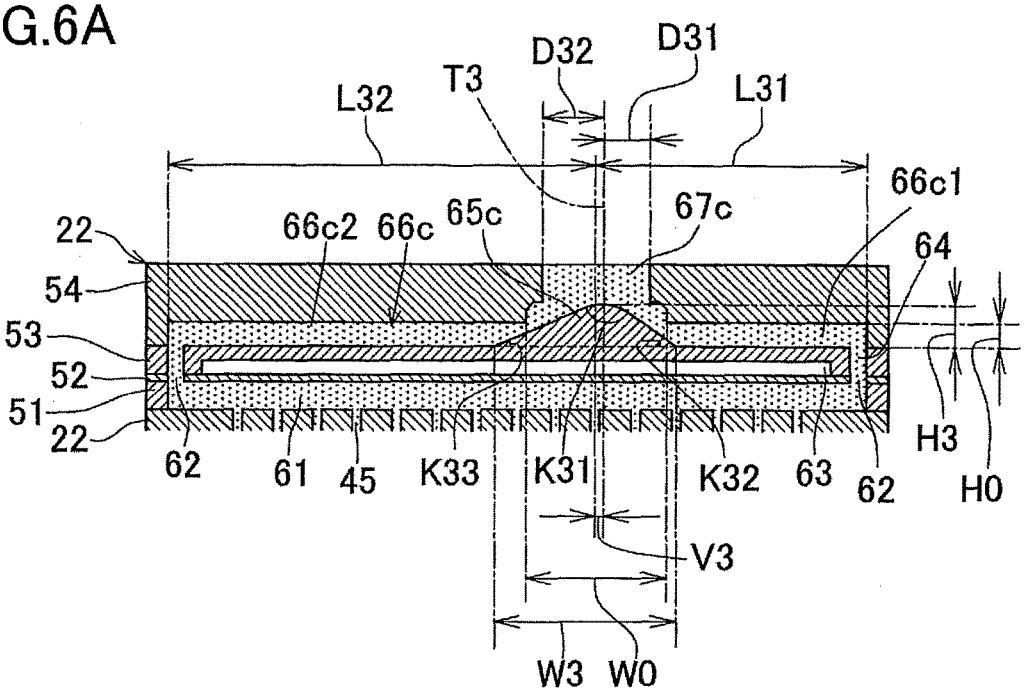
FIG. 6A is a cross-sectional view taken along line C-C in FIGS. 4A-4E and FIG. 6B is a cross-sectional view taken along line D-D in FIGS. 4A-4E.
Figure 6B:
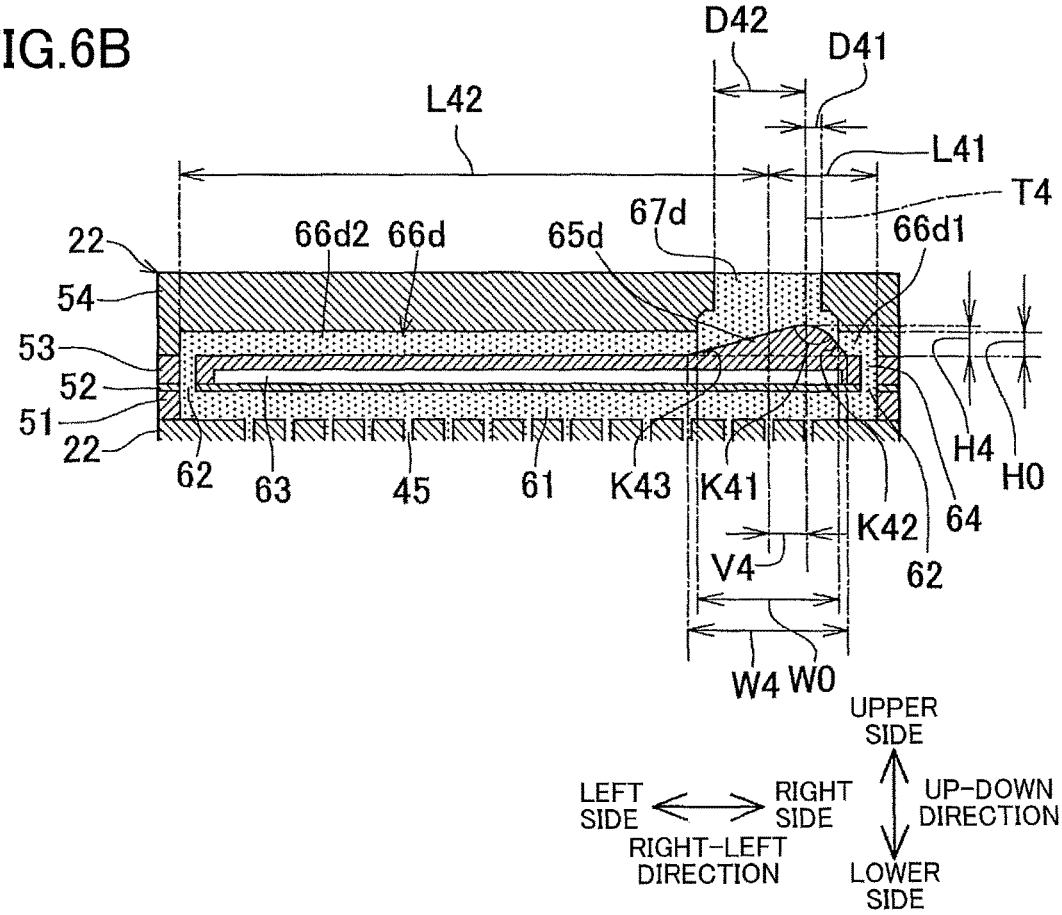
Figure 7A:
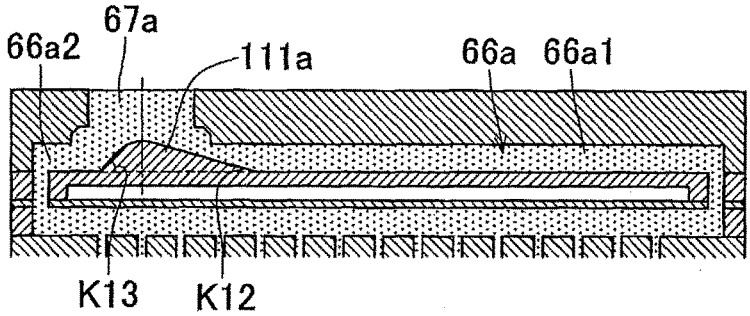
FIGS. 7A-7D are cross-sectional views respectively taken along horizontal passages 66*a*-66*d* of a supply unit according to a first modification.
Figure 7B:
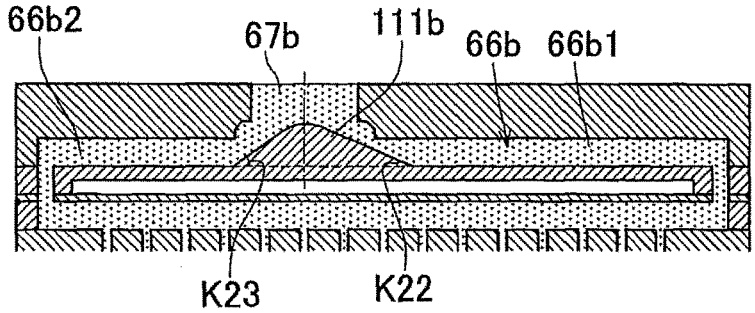
Figure 7C:
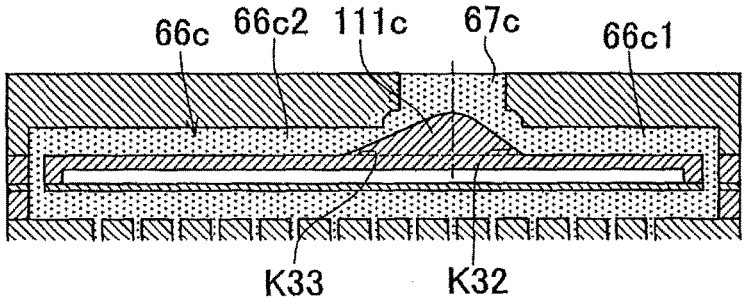
Figure 7D:
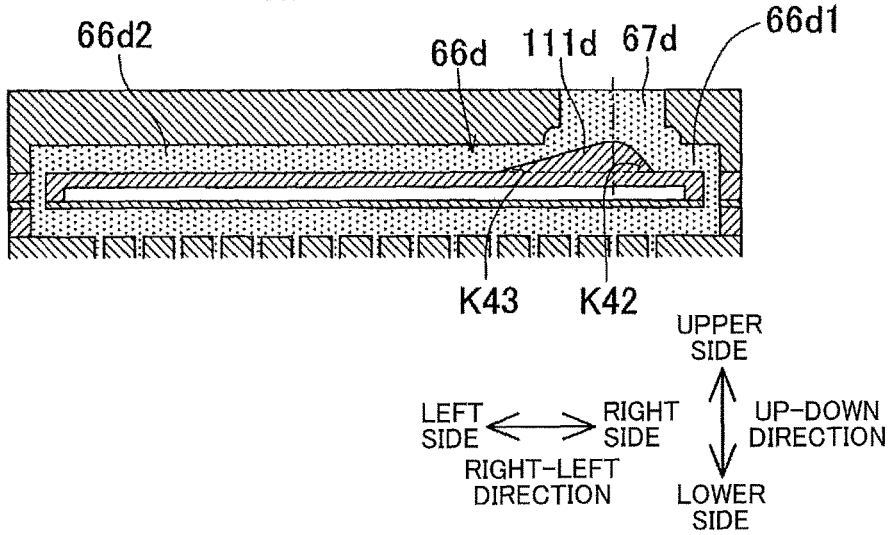
Figure 8A:
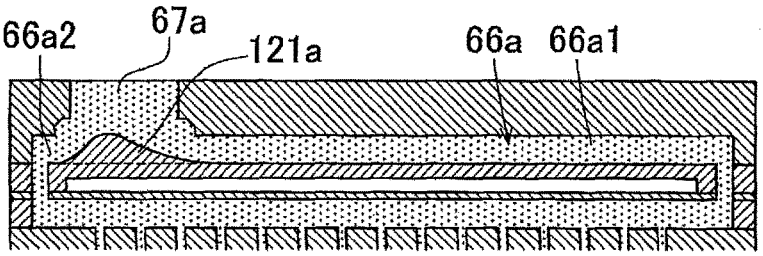
FIGS. 8A-8D are cross-sectional views respectively taken along horizontal passages 66*a*-66*d* of a supply unit according to a second modification.
Figure 8B:
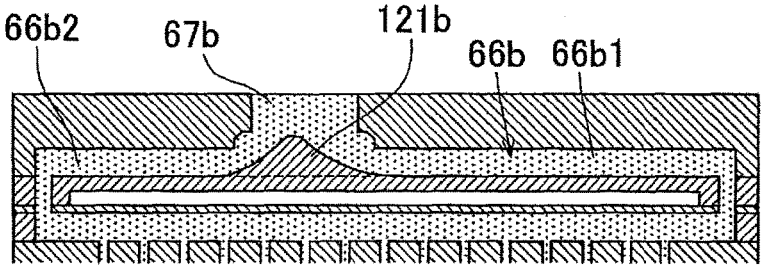
Figure 8C:
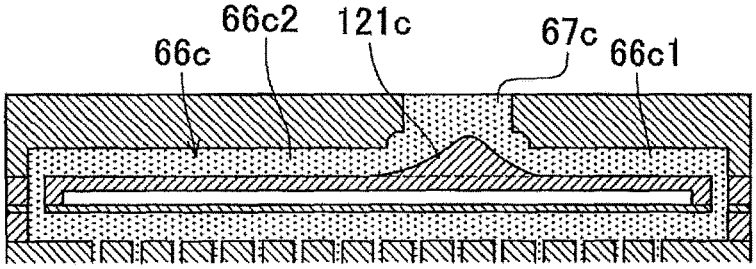
Figure 8D:
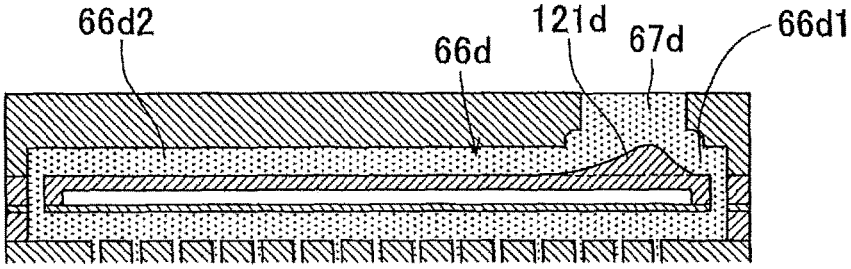
Figure 8D:
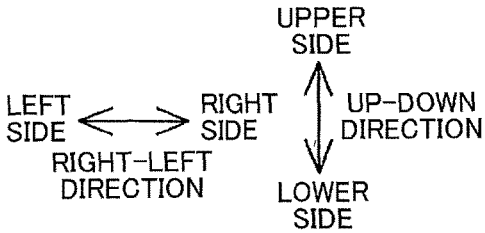
Figure 9A:
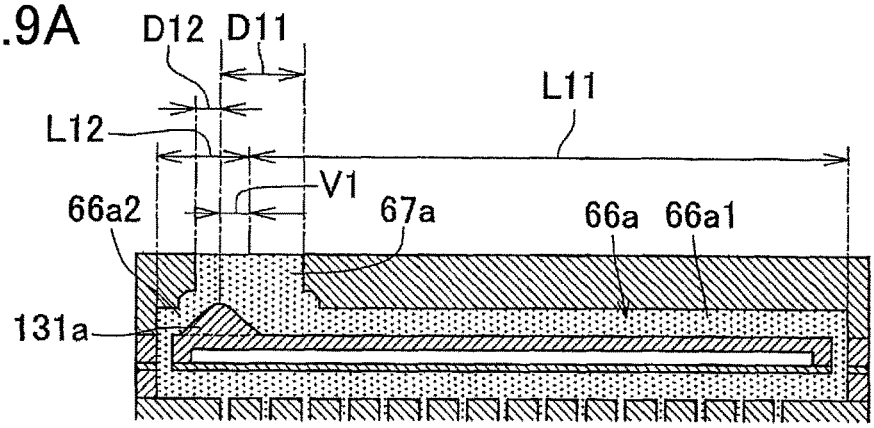
FIGS. 9A-9D are cross-sectional views respectively taken along horizontal passages 66*a*-66*d* of a supply unit according to a third modification.
Figure 9B:
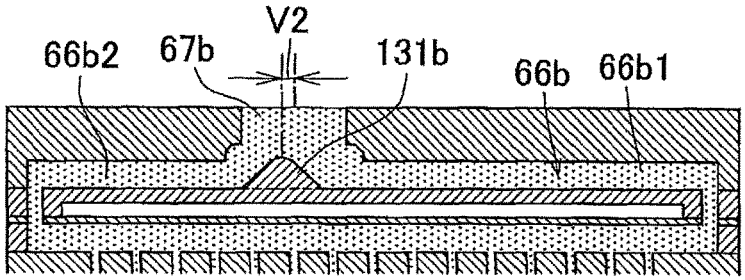
Figure 9C:
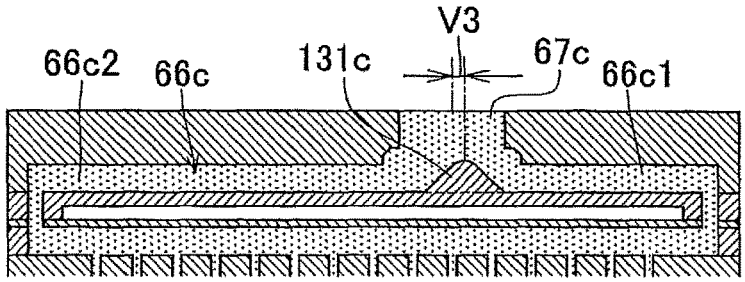
Figure 9D:
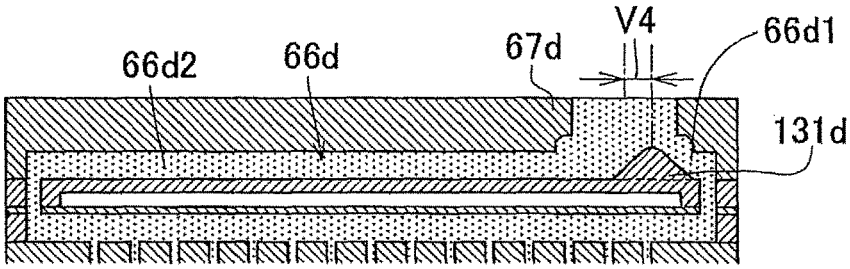
Figure 9D:
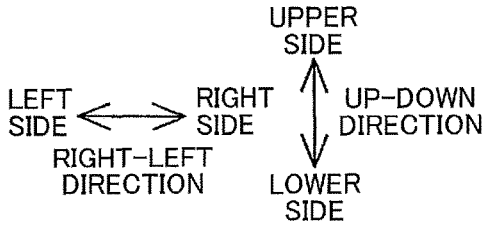

The support plate 35 is formed of silicon (Si). As shown in FIG. 3, the support plate 35 is disposed on an upper surface of the oscillating film 33. As shown in FIG. 3 and FIG. 4A, recesses 35*a* each extending in the right-left direction are formed in a lower surface of the support plate 35 at portions thereof overlapping the respective piezoelectric actuators 34. Thus, each of the four piezoelectric actuators 34 is disposed in a space defined between the oscillating film 33 and the corresponding recess 35*a* of the support plate 35. In the support plate 35, circular through-holes 35*b* extending in the up-down direction are formed at its portions overlapping the through-holes 33*a* of the oscillating film 33 in the up-down direction. With this configuration, there are formed, in the head chip 21, orifice passages 45 each defined by the through-hole 33*a* and the through-hole 35*b* and extending in the up-down direction. In FIG. 4A, FIGS. 5A, 5B, and FIGS. 6A, 6B, only a part of a plurality of orifice passages 45 are shown.

Supply Unit

As shown in FIGS. 4B-4E, FIGS. 5A, 5B, and FIGS. 6A, 6B, the supply unit 22 includes four plates 51-54 each having a generally rectangular shape. The plates 51-54 are formed by injection molding of a synthetic resin material, for instance.

The plate 51 is disposed on an upper surface of the support plate 35. Four manifolds 61 are formed in the plate 51. The four manifolds 61 extend in the right-left direction and are arranged in the front-rear direction. The rearmost manifold 61 corresponds to the first and the second pressure-chamber rows 7, the second manifold 61 from the rear corresponds to the third and the fourth pressure-chamber rows 7, the third manifold 61 from the rear corresponds to the fifth and the sixth pressure-chamber rows 7, and the fourth manifold 61 from the rear corresponds to the seventh and the eighth pressure-chamber rows 7. Each manifold 61 overlaps, in the up-down direction, a plurality of orifice passages 45 which correspond to corresponding two of the pressure-chamber rows 7.

The plate 52 is disposed on an upper surface of the plate 51. Through-holes 62 are formed in the plate 52 at portions thereof overlapping, in the up-down direction, opposite ends of each of the manifolds 61 in the right-left direction.

The plate 53 is disposed on an upper surface of the plate 52. In a lower portion of the plate 53, recesses 63 opening to a lower surface of the plate 53 are formed so as to extend in the right-left direction. Each of the recesses 63 overlaps, in the up-down direction, an inside area of a corresponding one of the manifolds 61, which inside area is located on the inner side of opposite ends of the manifold 61 in the right-left direction. Thus, the plate 52 is deformable at portions thereof overlapping the recesses 63. Deformation of the plate 52 at those portions makes it possible to reduce a pressure variation of the ink in the manifolds 61. The plate 52 has a smaller thickness than other three plates 51, 53, 54 and is accordingly easily deformable.

In the plate 53, through-holes 64 are formed so as to align with the through-holes 62 of the plate 52 in the up-down direction. Further, four protrusions 65*a*-65*d* protruding upward are provided on an upper surface of the plate 53 at portions overlapping the respective four manifolds 61 in the up-down direction. In the present embodiment, the protrusions 65*a*-65*d* and the plate 53 are integrally formed by injection molding, for instance. The protrusions 65*a*-65*d* may be formed otherwise. For instance, a liquid of synthetic resin or the like is dripped on the upper surface of the plate 53 formed by injection molding, and the liquid is cured to provide the protrusions 65*a*-65*d*. The shape and the position of the protrusions 65*a*-65*d* will be later explained in detail.

The plate 54 is disposed on the upper surface of the plate 53. In a lower portion of the plate 54, four horizontal passages 66*a*-66*d* (each as one example of "second flow passage") are formed. The four horizontal passages 66*a*-66*d* extend in the right-left direction (as one example of "second direction") and are disposed so as to align with the corresponding four manifolds 61 in the up-down direction. With this configuration, the four horizontal passages 66*a*-66*d* are arranged in the front-rear direction (as one example of "third direction"), like the four manifolds 61.

Four vertical passages 67*a*-67*d* (each as one example of "first flow passage") are formed in an upper portion of the plate 54 located above the lower portion thereof in which the four horizontal passages 66*a*-66*d* are formed. The vertical passage 67*a* overlaps, in the up-down direction, a left end portion of the horizontal passage 66*a*. The vertical passage 67*a* extends in the up-down direction (as one example of "first direction") and is connected, at its lower end, to the horizontal passage 66*a*. The vertical passage 67*b* is located on the right side of the vertical passage 67*a* in the right-left direction and overlaps the horizontal passage 66*b* in the up-down direction. The vertical passage 67*b* extends in the up-down direction and is connected, at its lower end, to the horizontal passage 66*b*. The vertical passage 67*c* is located on the right side of the vertical passage 67*b* in the right-left direction and overlaps the horizontal passage 66*c* in the up-down direction. The vertical passage 67*c* extends in the up-down direction and is connected, at its lower end, to the horizontal passage 66*c*. The vertical passage 67*d* is located on the right side of the vertical passage 67*c* in the right-left direction and overlaps the horizontal passage 66*d* in the up-down direction. The vertical passage 67*d* extends in the up-down direction and is connected, at its lower end, to the horizontal passage 66*d*. Each of the vertical passages 67*a*-67*d* has a dimension in the right-left direction larger at its lower end than its upper portion. Thus, each of the vertical passages 67*a*-67*d* has a larger cross sectional area at its lower end.

The vertical passages 67*a*-67*d* are disposed as described above, whereby the horizontal passages 66*a*-66*d* are configured as follows. The horizontal passage 66*a* includes two sections that extend in mutually opposite or different directions from a connected position at which the vertical passage 67*a* is connected to the horizontal passage 66*a*. That is, the horizontal passage 66*a* includes a section 66*a*1 (as one example of "first section") that extends rightward from the connected position and a section 66*a*2 (as one example of "second section") that extends leftward from the connected position. A length of the section 66a1 in the right-left direction is L11, and a length of the section 66a2 in the right-left direction is L12(<L11).

The horizontal passage 66b includes two sections that extend in mutually opposite or different directions from a connected position at which the vertical passage 67b is connected to the horizontal passage 66b. That is, the horizontal passage 66b includes a section 66b1 (as one example of "first section") that extends rightward from the connected position and a section 66b2 (as one example of "second section") that extends leftward from the connected position. A length of the section 66b1 in the right-left direction is L21, and a length of the section 66b2 in the right-left direction is L22(<L21). The length L21 of the section 66b1 is shorter than the length L11 of the section 66a1, and the length L22 of the section 66b2 is longer than the length L12 of the section 66a2.

The horizontal passage 66c includes two sections that extend in mutually opposite or different directions from a connected position at which the vertical passage 67c is connected to the horizontal passage 66c. That is, the horizontal passage 66c includes a section 66c1 (as one example of "second section") that extends rightward from the connected position and a section 66c2 (as one example of "first section") that extends leftward from the connected position. A length L31 of the section 66c1 in the right-left direction is equal to the length L22 of the section 66b2, and a length L32 of the section 66c2 in the right-left direction is equal to the length L21 of the section 66b1. That is, the length L32 of the section 66c2 is longer than the length L31 of the section 66c1.

The horizontal passage 66d includes two sections that extend in mutually opposite or different directions from a connected position at which the vertical passage 67d is connected to the horizontal passage 66d. That is, the horizontal passage 66d includes a section 66d1 (as one example of "second section") that extends rightward from the connected position and a section 66d2 (as one example of "first section") that extends leftward from the connected position. A length L41 of the section 66d1 in the right-left direction is equal to the length L12 of the section 66a2, and a length L42 of the section 66d2 in the right-left direction is equal to the length L11 of the section 66a1. That is, the length L42 of the section 66d2 is longer than the length L41 of the section 66d1.

Each of the horizontal passages 66a-66d has a constant dimension in the front-rear direction and a constant dimension in the up-down direction, throughout the right-left direction. With this configuration, the section 66a1 and the section 66a2 have the same cross sectional area orthogonal to the right-left direction, the section 66b1 and the section 66b2 have the same cross sectional area orthogonal to the right-left direction, the section 66c1 and the section 66c2 have the same cross sectional area orthogonal to the right-left direction, and the section 66d1 and the section 66d2 have the same cross sectional area orthogonal to the right-left direction.

Ink passages (not shown) are respectively connected to the upper end portions of the respective vertical passages 67a-67d, and the ink is supplied to the supply unit 22 through the upper end portions of the vertical passages 67a-67d.

Protrusion

The protrusions 65a-65d are next explained. The protrusion 65a is provided at a portion on a lower-side inner wall surface of the horizontal passage 66a defined by the upper surface of the plate 53, which portion overlaps the vertical passage 67a in the up-down direction. The protrusion 65a protrudes upward toward the vertical passage 67a. The shape of the protrusion 65a projected onto a plane orthogonal to the front-rear direction (i.e., a plane parallel to both of the right-left direction and the up-down direction) is a triangle. Further, one of angles of the triangle that corresponds to a tip of the protrusion 65a, i.e., an angle K11 of the tip, is an obtuse angle. The entirety of the protrusion 65a including the tip extends over the entire dimension of the horizontal passage 66a in the front-rear direction. The tip of the protrusion 65a is rounded or chamfered. The protrusion 65a has a length W1 in the right-left direction longer than a length W0 of the lower end portion of the vertical passage 67a, so as to extend outward beyond opposite ends of the vertical passage 67a in the right-left direction. The protrusion 65a has a height H1 higher than a height H0 of the horizontal passage 66a, so as to protrude into the vertical passage 67a.

The protrusion 65a is asymmetrical in the right-left direction with respect to a straight line T1 which passes the tip and which is parallel to the up-down direction, namely, with respect to a plane which is orthogonal to the right-left direction and on which the tip exists. In other words, the protrusion 65a has different shapes between its right-side portion located on the right side of the tip and facing the section 66a1 (as one example of "first-section facing portion") and its left-side portion located on the left side of the tip and facing the section 66a2 (as one example of "second-section facing portion"). The right-side portion of the protrusion 65a facing the section 66a1 has an inclination angle K12 with respect to the right-left direction smaller than an inclination angle K13 with respect to the right-left direction of the left-side portion of the protrusion 65a facing the section 66a2.

The tip of the protrusion 65a is shifted leftward (i.e., toward the section 66a2) in the right-left direction by a shift amount V1 from a center of the vertical passage 67a. Where a distance in the right-left direction between the right end of the vertical passage 67a and the tip of the protrusion 65a is D11 and a distance in the right-left direction between the left end of the vertical passage 67a and the tip of the protrusion 65a is D12, a ratio of the distance D11 and the distance D12, i.e., [D11:D12], is substantially equal to a ratio of the length L11 of the section 66a1 and the length L12 of the section 66a2, i.e., [L11:L12].

The protrusion 65b is provided at a portion on a lower-side inner wall surface of the horizontal passage 66b defined by the upper surface of the plate 53, which portion overlaps the vertical passage 67b in the up-down direction. The protrusion 65b protrudes upward toward the vertical passage 67b. The shape of the protrusion 65b projected onto the plane orthogonal to the front-rear direction is a triangle. Further, one of angles of the triangle that corresponds to a tip of the protrusion 65b, i.e., an angle K21 of the tip, is an obtuse angle. The entirety of the protrusion 65b including the tip extends over the entire dimension of the horizontal passage 66b in the front-rear direction. The tip of the protrusion 65b is rounded or chamfered. The protrusion 65b has a length W2(>W1) in the right-left direction, so as to extend outward beyond opposite ends of the vertical passage 67b in the right-left direction. The protrusion 65b has a height H2(>H1), so as to protrude into the vertical passage 67b.

The protrusion 65b is asymmetrical in the right-left direction with respect to a straight line T2 which passes the tip and which is parallel to the up-down direction, namely, with respect to the plane which is orthogonal to the right-left direction and on which the tip exists. In other words, the protrusion 65*b* has different shapes between its right-side portion located on the right side of the tip and facing the section 66*b*1 (as one example of "first-section facing portion") and its left-side portion located on the left side and facing the section 66*b*2 (as one example of "second-section facing portion"). The right-side portion of the protrusion 65*b* facing the section 66*b*1 has an inclination angle K22 with respect to the right-left direction smaller than an inclination angle K23 with respect to the right-left direction of the left-side portion of the protrusion 65*b* facing the section 66*b*2. Further, a difference between the inclination angle K22 and the inclination angle K23, i.e., [K23−K22], is smaller than a difference between the inclination angle K12 and the inclination angle K13 of the protrusion 65*a*, i.e., [K13−K12].

The tip of the protrusion 65*b* is shifted leftward (i.e., toward the section 66*b*2) in the right-left direction by a shift amount V2(<V1) from a center of the vertical passage 67*b*. Where a distance in the right-left direction between the right end of the vertical passage 67*b* and the tip of the protrusion 65*b* is D21 and a distance between the left end of the vertical passage 67*b* and the tip of the protrusion 65*b* is D22, a ratio of the distance D21 and the distance D22, i.e., [D21:D22], is substantially equal to a ratio of the length L21 of the section 66*b*1 and the length L22 of the section 66*b*2, i.e., [L21:L22].

The protrusion 65*c* is provided at a portion on a lower-side inner wall surface of the horizontal passage 66*c* defined by the upper surface of the plate 53, which portion overlaps the vertical passage 67*c* in the up-down direction. The protrusion 65*c* protrudes upward toward the vertical passage 67*c*. The shape of the protrusion 65*c* projected onto the plane orthogonal to the front-rear direction is a triangle. Further, one of angles of the triangle that corresponds to the tip of the protrusion 65*c*, i.e., an angle K31 of the tip, is equal to the angle K21 of the tip of the protrusion 65*b* and is an obtuse angle. The entirety of the protrusion 65*c* including the tip extends over the entire dimension of the horizontal passage 66*c* in the front-rear direction. The tip of the protrusion 65*c* is rounded or chamfered. The protrusion 65*c* has a length W3 in the right-left direction equal to the length W2 of the protrusion 65*b*, so as to extend outward beyond opposite ends of the vertical passage 67*c* in the right-left direction. The protrusion 65*c* has a height H3 equal to the height H2 of the protrusion 65*b*, so as to protrude into the vertical passage 67*c*.

The protrusion 65*c* is asymmetrical in the right-left direction with respect to a straight line T3 which passes the tip and which is parallel to the up-down direction, namely, with respect to the plane which is orthogonal to the right-left direction and on which the tip exists. In other words, the protrusion 65*c* has different shapes between its right-side portion located on the right side of the tip and facing the section 66*c*1 (as one example of "second-section facing portion") and its left-side portion located on the left side of the tip and facing the section 66*c*2 (as one example of "first-section facing portion"). The right-side portion of the protrusion 65*c* facing the section 66*c*1 has an inclination angle K32 with respect to the right-left direction equal to the inclination angle K23 of the protrusion 65*b*, and the left-side portion of the protrusion 65*c* facing the section 66*c*2 has an inclination angle K33 with respect to the right-left direction equal to the inclination angle K22 of the protrusion 65*b*. Thus, the inclination angle K33 is smaller than the inclination angle K32.

The tip of the protrusion 65*c* is shifted rightward (i.e., toward the section 66*c*1) in the right-left direction by a shift amount V3 from a center of the vertical passage 67*c*. The shift amount V3 is equal to the shift amount V2 of the protrusion 65*b*. Where a distance in the right-left direction between the right end of the vertical passage 67*c* and the tip of the protrusion 65*c* is D31(=D22) and a distance between the left end of the vertical passage 67*c* and the tip of the protrusion 65*c* is D32(=D21), a ratio of the distance D31 (=D22) and the distance D32(=D21), i.e., [D31:D32](=[D22:D21]), is substantially equal to a ratio of the length L31(=L22) of the section 66*c*1 and the length L32(=L21) of the section 66*c*2, i.e., [L31:L32](=[L22:L21]).

The protrusion 65*d* is provided at a portion on a lower-side inner wall surface of the horizontal passage 66*d* defined by the upper surface of the plate 53, which portion overlaps the vertical passage 67*d* in the up-down direction. The protrusion 65*d* protrudes upward toward the vertical passage 67*d*. The shape of the protrusion 65*d* projected onto the plane orthogonal to the front-rear direction is a triangle. Further, one of angles of the triangle that corresponds to a tip of the protrusion 65*d*, i.e., an angle K41 of the tip, is equal to the angle K11 of the tip of the protrusion 65*a* and is an obtuse angle. The entirety of the protrusion 65*d* including the tip extends over the entire dimension of the horizontal passage 66*d* in the front-rear direction. The tip of the protrusion 65*d* is rounded or chamfered. The protrusion 65*d* has a length W4 in the right-left direction equal to the length W1 of the protrusion 65*a*, so as to extend outward beyond opposite ends of the vertical passage 67*d* in the right-left direction. The protrusion 65*d* has a height H4 equal to the height H1 of the protrusion 65*a*, so as to protrude into the vertical passage 67*d*.

The protrusion 65*d* is asymmetrical in the right-left direction with respect to a straight line T4 which passes the tip and which is parallel to the up-down direction, namely, with respect to the plane which is orthogonal to the right-left direction and on which the tip exists. In other words, the protrusion 65*d* has different shapes between its right-side portion located on the right side of the tip and facing the section 66*d*1 (as one example of "second-section facing portion) and its left-side portion located on the left side of the tip and facing the section 66*d*2 (as one example of "first-section facing portion). The right-side portion of the protrusion 65*d* facing the section 66*d*1 has an inclination angle K42 with respect to the right-left direction equal to the inclination angle K13 of the protrusion 65*a*, and the left-side portion of the protrusion 65*d* facing the section 66*d*2 has an inclination angle K43 with respect to the right-left direction equal to the inclination angle K12 of the protrusion 65*a*. Thus, the inclination angle K43 is smaller than the inclination angle K42.

The tip of the protrusion 65*d* is shifted rightward (i.e., toward the section 66*d*1) in the right-left direction by a shift amount V4 from a center of the vertical passage 67*d*. The shift amount V4 is equal to the shift amount V1 of the protrusion 65*a*. Where a distance in the right-left direction between the right end of the vertical passage 67*d* and the tip of the protrusion 65*d* is D41(=D12) and a distance between the left end of the vertical passage 67*d* and the tip of the protrusion 65*d* is D42(=D11), a ratio of the distance D41 (=D12) and the distance D42(=D11), i.e., [D41:D42](=[D12:D11]), is substantially equal to a ratio of the length L41(=L12) of the section 66d1 and the length L42(=L11) of the section 66d2, i.e., [L41:L42](=[L12:L11]).

In the supply unit 22, when the ink is supplied through the upper portion of the vertical passage 67a, the ink flows from the vertical passage 67a into the horizontal passage 66a. The ink that flows into the horizontal passage 66a flows into the sections 66a1, 66a2, and then flows from respective end portions of the sections 66a1, 66a2 into the manifold 61 via the through-holes 62, 64. The ink that flows into the manifold 61 is supplied into the pressure chambers 40 via the corresponding orifice passages 45. The ink supplied from the upper portions of the respective vertical passages 67b-67d similarly flows. In the present embodiment, ink passages in the supply unit 22 including the manifolds 61, the through-holes 62, 64, the horizontal passages 66a-66d, and the vertical passages 67a-67d correspond to a supply passage.

In the present embodiment, the length L11 of the section 66a1 is longer than the length L12 of the section 66a2 as described above. Therefore, the section 66a1 has a larger liquid flow resistance than the section 66a2. Specifically, the liquid flow resistance indicates a degree of difficulty for the ink to flow. The ink is less likely to flow with an increase in the liquid flow resistance. The liquid flow resistance is proportional to a length of a flow passage and is inversely proportional to its cross sectional area. In the present embodiment, the cross sectional areas of the section 66a1 and the section 66a2 are the same, and the length L11 of the section 66a1 is longer than the length L12 of the section 66a2, so that the section 66a1 has a larger liquid flow resistance than the section 66a2.

In the present embodiment, the section 66a1 has a larger liquid flow resistance than the section 66a2. Unlike the present embodiment, if the protrusion 65a is not provided, the ink that flows into the horizontal passage 66a tends to flow in the section 66a2 rather than in the section 66a1. In this case, the ink tends to flow into the manifold 61 from the through-holes 62, 64 located on the left-side on which the section 66a2 is located rather than the through-holes 62, 64 located on the right side on which the section 66a1 is located. As a result, the amount of the ink supplied to the right-side portion of the manifold 61 becomes small, causing a risk that the ink is not sufficiently supplied to the pressure chambers 40 communicating with the right-side portion of the manifold 61. Unlike the present embodiment, if the protrusions 65b-65d are not provided in the horizontal passages 66b-66d, the similar problem may arise when the ink is supplied to the pressure chambers 40 from the manifolds 61 communicating with the corresponding horizontal passages 66b-66d.

In the present embodiment, therefore, the protrusion 65a-65d is provided on the wall surface of the horizontal passage 66a-66d facing the vertical passage 67a-67d. The ink that flows from the vertical passage 67a into the horizontal passage 66a is guided by the surface of the protrusion 65a and flows in mutually opposite directions, namely, flows into the two sections 66a1, 66a2. In this instance, the right-side portion of the protrusion 65a facing the section 66a1 has the inclination angle K12 with respect to the right-left direction smaller than the inclination angle K13 with respect to the right-left direction of the left-side portion of the protrusion 65a facing the section 66a2, so that the ink tends to easily flow into the section 66a1. Further, the tip of the protrusion 65a is shifted toward the section 66a2 from the center of the vertical passage 67a in the right-left direction, so that the ink tends to easily flow into the section 66a1.

According to the present embodiment, the ink that flows from the vertical passage 67a into the horizontal passage 66a can flow evenly in the two sections 66a1, 66a2. Similarly, the ink that flows from the vertical passages 67b-67d into the horizontal passages 66b-66d can flow evenly in the two sections 66b1, 66b2, evenly in the two sections 66c1, 66c2, and evenly in the two sections 66d1, 66d2.

In the present embodiment, the vertical passages 67a-67d are shifted relative to each other in the right-left direction, so as to provide enough space for forming the vertical passages 67a-67d and the ink passages connected to the upper portions of the respective vertical passages 67a-67d. In this respect, when the vertical passages 67a-67d are shifted relative to each other in the right-left direction, the connected position at which each vertical passage 67a-67d is connected to the corresponding horizontal passage 66a-66d differs in the right-left direction among the horizontal passages 66a-66d. As a result, in the present embodiment, a difference in length between the two sections of the respective horizontal passages 66a, 66d [L11-L12](=[L42-L41]) is larger than a difference in length between the two sections in the respective horizontal passages 66b, 66c [L21-L22](=[L32-L31]). Consequently, a difference in the liquid flow resistance between the two sections of the horizontal passages 66a, 66d is larger than that of the two sections of the horizontal passage 66b, 66c. In other words, when focusing on each of the horizontal passages 66a-66d, the difference in the liquid flow resistance between the two sections increases with an increase in a distance in the right-left direction between the center of the horizontal passage (66a-66d) and the connected position at which the vertical passage (67a-67d) is connected to the horizontal passage.

In the present embodiment, a difference in the inclination angle with respect to the right-left direction between the two portions of each protrusion 65a, 65d facing the respective two sections, i.e., [K13−K12](=[K42−K43]), is made larger than that between the two portions of each protrusion 65b, 65c facing the respective two sections, i.e., [K23−K22](=[K32−K33]). With an increase in the difference in the inclination angle, the ink tends to more easily flow into the section for which the difference in the inclination angle is small. In the present embodiment, the shift amount V1(=V4) of the tip of the protrusion 65a, 65d in the right-left direction from the center of the vertical passage 67a, 67d is made larger than the shift amount V2(=V3) of the tip of the protrusion 65b, 65c in the right-left direction from the center of the vertical passage 67b, 67c. With an increase in the shift amount, the ink tends to more easily flow into the section opposite to another section toward which the tip of the protrusion is shifted in the right-left direction from the center of the vertical passage. Thus, the present embodiment enables the ink that flows from each vertical passage 67a-67d to uniformly or evenly flow into the two sections of each horizontal passage 66a-66d.

The protrusion 65a is disposed at a position at which the ratio [D11:D12] of the distance D11 between the tip of the protrusion 65a and the right end of the vertical passage 67a and the distance D12 between the tip of the protrusion 65a and the left end of the vertical passage 67a is substantially equal to the ratio [L11:L12] of the length L11 of the section 66a1 and the length L12 of the section 66a2. In other words, the tip of the protrusion 65a is disposed at a position in accordance with the ratio of the liquid flow resistance between the section 66a1 and the section 66a2. Thus, the ink uniformly flows into the two sections 66a1, 66a2. This is true of the positions of the tips of the respective protrusions 65b-65d in the right-left direction. Consequently, the liquid uniformly flows in the two sections of each of the horizontal passages 66b-66d.

In the present embodiment, each protrusion 65*a*-65*d* extends outward of the corresponding vertical passage 67*a*-67*d* in the right-left direction beyond its opposite ends in the right-left direction. As compared with an arrangement in which the lengths W1-W4 of the protrusions 65*a*-65*d* are not larger than the length W0 of the vertical passages 67*a*-67*d* and each protrusion 65*a*-65*d* extends in the right-left direction within a range in which the corresponding vertical passage 67*a*-67*d* is disposed, each protrusion 65*a*-65*d* has a larger dimension in the right-left direction, and the inclination angle with respect to the right-left direction of the two portions of the protrusion 65*a*-65*d* facing the respective two sections can be made smaller in the present embodiment. Consequently, the present embodiment reduces a pressure loss of the ink due to collision with the protrusions 65*a*-65*d* when the ink flows from the vertical passages 67*a*-67*d* into the horizontal passages 66*a*-66*d*.

In the present embodiment, the protrusions 65*a*-65*d* protrude into the respective vertical passages 67*a*-67*d*. As compared with an arrangement in which the heights H1-H4 of the respective protrusions 65*a*-65*d* are not larger than the height H0 of the horizontal passages 66*a*-66*d* and the tips of the respective protrusions 65*a*-65*d* are located at respective positions lower than the corresponding vertical passages 67*a*-67*d*, the ink flows more easily in mutually opposite directions toward the respective two sections when the ink flows from the vertical passages 67*a*-67*d* into the horizontal passages 66*a*-66*d*.

In the present embodiment, the tip of each protrusion 65*a*-65*d* extends over the entire dimension in the front-rear direction of the corresponding horizontal passage 66*a*-66*d*. In this structure, when the ink flows from the vertical passages 67*a*-67*d* into the horizontal passages 66*a*-66*d*, the ink that collides with the tip of each protrusion 65*a*-65*d* flows more easily in mutually opposite directions into the two sections.

In the present embodiment, each of the vertical passages 67*a*-67*d* has a larger cross sectional area at its lower end, thereby reducing a pressure loss of the ink when the ink flows from the vertical passages 67*a*-67*d* into the horizontal passages 66*a*-66*d*.

In the present embodiment, the projective shape of each protrusion 65*a*-65*d* projected onto the plane orthogonal to the front-rear direction is a triangle, simplifying the shape of each protrusion 65*a*-65*d*. Further, the angles K11, K21, K31, K41, each of which corresponds to an angle of the tip of each protrusion 65*a*-65*d*, are obtuse angles. As compared with an arrangement in which the angles are not greater than 90°, it is possible to reduce a pressure loss of the ink due to collision with the tips of the protrusions 65*a*-65*d* when the ink flows from the vertical passages 67*a*-67*d* into the horizontal passages 66*a*-66*d*.

In the present embodiment, the tip of each of the protrusions 65*a*-65*d* is rounded or chamfered, thereby preventing the tips of the protrusions 65*a*-65*d* from being damaged due to collision of the ink with the protrusions 65*a*-65*d*.

In the present embodiment, the length W2(=W3) of the protrusions 65*b*, 65*c* in the right-left direction is larger than the length W1(=W4) of the protrusions 65*a*, 65*d*. Further, the height H2(=H3) of the protrusions 65*b*, 65*c* is larger than the height H1(=H4) of the protrusions 65*a*, 65*d*. In other words, when focusing on each of the protrusions, the length of the protrusion in the right-left direction and the height of the protrusion increase with a decrease in the distance in the right-left direction between the center of the horizontal passage and the connected position at which the vertical passage is connected to the horizontal passage. This arrangement makes it possible to increase the rigidity of a central portion in the right-left direction of the plate 53 which is longer in the right-left direction and prevents warpage of the supply unit 22 when the plates 51-54 are bonded thereto.

In the present embodiment, the length W2(=W3) of the protrusions 65*b*, 65*c* is larger than the length W1(=W4) of the protrusions 65*a*, 65*d*, and the height H2(=H3) of the protrusions 65*b*, 65*c* is larger than the height H1(=H4) of the protrusions 65*a*, 65*d*, whereby the protrusions 65*a*, 65*d* has a volume smaller than that of the protrusions 65*b*, 65*c*. Consequently, the cross sectional area of the portion of each horizontal passage 66*a*, 66*d* at which the corresponding protrusion 65*a*, 65*d* is provided is larger than the cross sectional area of the portion of each horizontal passage 66*b*, 66*c* at which the corresponding protrusion 65*b*, 65*c* is provided. That is, when focusing each of the horizontal passages 66*a*-66*d*, the cross sectional area increases with an increase in the distance in the right-left direction between the center of the horizontal passage and the connected position at which the vertical passage is connected to the horizontal passage. Further, the length in the right-left direction of the first section of the horizontal passage, namely, the liquid flow resistance, increases with an increase in the distance in the right-left direction between the center of the horizontal passage and the connected position at which the vertical passage is connected to the horizontal passage. In the present embodiment, the cross sectional areas of the portions of the horizontal passages 66*a*-66*d* at which the protrusions 65*a*-65*d* are provided are designed as described above, so that the ink flows more easily into the section having a larger liquid flow resistance.

There will be next explained modifications.

In the illustrated embodiment, when focusing on each of the four protrusions 65*a*-65*d*, the length in the right-left direction of the protrusion and the height of the protrusion increase with a decrease in the distance in the right-left direction between the center of the horizontal passage and the connected position at which the vertical passage is connected to the horizontal passage. This configuration need not be necessarily employed.

For instance, the configuration relating to the length in the right-left direction of the protrusion may be employed for only two or three of the four protrusions 65*a*-65*d*. Further, the four protrusions 65*a*-65*d* may have the same length in the right-left direction.

The configuration relating to the height of protrusion may be employed for only two or three of the four protrusions 65*a*-65*d*. Further, the four protrusions 65*a*-65*d* may have the same height.

In the illustrated embodiment, when focusing on each of the four protrusions 65*a*-65*d*, the shift amount of the tip of the protrusion in the right-left direction from the center of the vertical passage increases with an increase in the distance in the right-left direction between the center of the horizontal passage and the connected position at which the vertical passage is connected to the horizontal passage. This configuration need not be necessarily employed.

For instance, the configuration relating to the shift amount may be employed for only two or three of the four protrusions 65*a*-65*d*. Further, the shift amounts in the right-left direction of the tips of the respective four protrusions 65*a*-65*d* from the corresponding vertical passages 67*a*-67*d* may be the same.

In the illustrated embodiment, when focusing on each of the four protrusions 65*a*-65*d*, the difference in the inclination angle with respect to the right-left direction between the two portions of the protrusion facing the respective two sections of the horizontal passage increases with an increase in the distance in the right-left direction between the center of the horizontal passage and the connected position at which the vertical passage is connected to the horizontal passage. This configuration need not be necessarily employed.

For instance, the configuration relating to the difference in the inclination angle may be employed for only two or three of the four protrusions 65*a*-65*d*. Further, the difference in the inclination may be the same for all of the four protrusions 65*a*-65*d*.

In the illustrated embodiment, when focusing on each of the four horizontal passages 66*a*-66*d*, the cross sectional area of the portion of the horizontal passage at which the protrusion is provided increases with an increase in the distance in the right-left direction between the center of the horizontal passage and the connected position at which the vertical passage is connected to the horizontal passage. This configuration need not be necessarily employed.

For instance, the configuration relating to the cross sectional area may be employed for only two or three of the four horizontal passages. Further, the cross sectional area may be the same for all of the four horizontal passages.

In the illustrated embodiment, the ratio [D11:D12] of the distance between the tip of the protrusion 65*a* and the right end of the vertical passage 67*a* and the distance between the tip of the protrusion 65*a* and the left end of the vertical passage 67*a* is substantially equal to the ratio [L11:L12] of the lengths of the two sections 66*a*1, 66*a*2. This configuration need not be necessarily employed. The tip of the protrusion 65*a* may be disposed at position in the right-left direction in accordance with the ratio [L11:L12] different from the position in the illustrated embodiment. This is true of the protrusions 65*b*-65*d*.

In the illustrated embodiment, the tip of each protrusion 65*a*-65*d* extends throughout in the front-rear direction of the corresponding horizontal passage 66*a*-66*d*. This is not necessarily required. For instance, the shape of each protrusion 65*a*-65*d* may be a triangular pyramid. In this case, the tip of each protrusion 65*a*-65*d* need not extend throughout in the front-rear direction of the corresponding horizontal passage 66*a*-66*d*.

In the illustrated embodiment, each protrusion 65*a*-65*d* extends outward beyond the opposite ends of the corresponding vertical passage 67*a*-67*d* in the right-left direction. This is not necessarily required. At least one of the protrusions 65*a*-65*d* may have the length in the right-left direction equal to or smaller than the length W0 of the vertical passage and may extend within a range in the right-left direction in which the vertical passage is disposed.

In the illustrated embodiment, each protrusion 65*a*-65*d* protrudes into the corresponding vertical passage 67*a*-67*d*. This is not necessarily required. At least one of the protrusions 65*a*-65*d* may have a height equal to or smaller than the height H0 of the horizontal passage and may be located at a lower position than the vertical passage.

In the illustrated embodiment, each vertical passage 67*a*-67*d* has a larger cross sectional area at its lower end. This is not necessarily required. For instance, at least one of the vertical passages 67*a*-67*d* may have a constant length in the right-left direction throughout the up-down direction. In other words, at least one of the vertical passages 67*a*-67*d* may be a passage having a constant cross sectional area.

In the illustrated embodiment, the tip of each protrusion 65*a*-65*d* is shifted from the center of the corresponding vertical passage 67*a*-67*d* in the right-left direction. This is not necessarily required. In a first modification shown in FIG. 7, each of protrusions 111*a*-111*d* provided for the respective horizontal passages 66*a*-66*d* is located at the same position as the center of the corresponding vertical passage 67*a*-67*d* in the right-left direction. It is noted that the shape of each protrusion 111*a*-111*d* is the same as that of the protrusion 65*a*-65*d* in the illustrated embodiment.

Also in the first modification, the inclination angle K12 with respect to the right-left of the portion of the protrusion 111*a* facing the section 66*a*1 is smaller than the inclination angle K13 with respect to the right-left direction of the portion of the protrusion 111*a* facing the section 66*a*2. Consequently, the pressure loss of the ink when flows from the vertical passage 67*a* into the section 66*a*1 is smaller than that when flows into the section 66*a*2, whereby the ink flows more easily into the section 66*a*1.

The inclination angle K22 with respect to the right-left direction of the portion of the protrusion 111*b* facing the section 66*b*1 is smaller than the inclination angle K23 with respect to the right-left direction of the portion of the protrusion 111*b* facing the section 66*b*2, whereby the ink flow more easily into the section 66*b*1. The inclination angle K33(=K22) with respect to the right-left direction of the portion of the protrusion 111*c* facing the section 66*c*2 is smaller than the inclination angle K32(=K23) with respect to the right-left direction of the portion of the protrusion 111*c* facing the section 66*c*1, whereby the ink flow more easily into the section 66*c*2. The inclination angle K43(=K12) with respect to the right-left direction of the portion of the protrusion 111*d* facing the section 66*d*2 is smaller than the inclination angle K42(=K13) with respect to the right-left direction of the portion of the protrusion 111*d* facing the section 66*d*1, whereby the ink flow more easily into the section 66*d*2.

In the illustrated embodiment, the portions of each protrusion 65*a*-65*d* facing the respective two sections of the corresponding horizontal passage 66*a*-66*d* have flat surfaces. This is not necessarily required. In a second modification shown in FIGS. 8A-8D, portions of each of protrusions 121*a*-121*d* provided for the respective horizontal passages 66*a*-66*d* and facing the two sections of the corresponding horizontal passage 66*a*-66*d* have curved surfaces each of which is concave. In this case, the ink which flows from the vertical passages 67*a*-67*d* into the horizontal passages 66*a*-66*d* flows while being guided by the curved surfaces of the protrusions 121*a*-121*d*, making it possible to more effectively reduce the pressure loss of the ink that collides with the protrusions 121*a*-121*d*.

In the illustrated embodiment, the shape of each protrusion 65*a*-65*d* projected onto the plane orthogonal to the front-rear direction is the triangle whose one angle, which corresponds to the tip of each of the protrusions 65*a*-65*d*, is an obtuse angle, namely, the angles K11, K21, K31, K41 of the tips of the respective protrusions 65*a*-65*d* are an obtuse angle, and the tip of each protrusion 65*a*-65*d* is rounded or chamfered. This is not necessarily required. Each of the angles K11, K21, K31, K41 may be an angle not larger than 90°. Further, the tip of each protrusion 65*a*-65*d* need not be rounded or chamfered. Moreover, the shape of each protrusion 65*a*-65*d* projected onto the plane orthogonal to the front-rear direction is not limited to the triangle, but may be shapes other than the triangle, such as a trapezoid.

In the illustrated embodiment, the inclination angle with respect to the right-left direction is made different between the two portions of each protrusion 65*a*-65*d* facing the respective two sections of the corresponding horizontal passage, whereby the degree of easiness for the ink to flow is made different between the two sections. The degree of easiness for the ink to flow may be made different between the two portions by differently shaping each protrusion 65*a*-65*d* other than by making the inclination angle with respect to the right-left direction of the two portions different.

In the illustrated embodiment, each of the protrusions 65*a*-65*d* is asymmetrical with respect to the plane which is orthogonal to the right-left direction and on which the tip exists. This is not necessarily required. In a third modification shown in FIGS. 9A-9D, four protrusions 131*a*-131*d* provided for the respective four horizontal passages 66*a*-66*d* have the mutually the same shape. Further, the shape of each protrusion 131*a*-131*d* projected onto the plane orthogonal to the front-rear direction is an isosceles triangle which is symmetrical in the right-left direction with respect to the plane which is orthogonal to the right-left direction and on which the tip exists.

In the third modification, the tip of the protrusion 131*a* is shifted leftward by the shift amount V1 from the center of the vertical passage 67*a* in the right-left direction. The tip of the protrusion 131*b* is shifted leftward by the shift amount V2 from the center of the vertical passage 67*b* in the right-left direction. The tip of the protrusion 131*c* is shifted rightward by the shift amount V3(=V2) from the center of the vertical passage 67*a* in the right-left direction. The tip of the protrusion 131*d* is shifted rightward by the shift amount V4(=V1) from the center of the vertical passage 67*d* in the right-left direction. In other words, in the third modification, a relative position of each of the protrusions 131*a*-131*d* and a corresponding one of the vertical passages differs among the four horizontal passages 66*a*-66*d*.

In the third modification, the tip of each protrusion 131*a*-131*d* is located so as to be shifted toward one of the two sections which has a smaller length in the right-left direction, namely, which has a smaller liquid flow resistance. As compared with an arrangement in which no protrusions 131*a*-131*d* are not provided, the ink which flows from the vertical passage 67*a*-67*d* into the horizontal passage 66*a*-66*d* tends to flow more easily into another of the two sections which has a larger length in the right-left direction, namely, which has a larger liquid flow resistance. Consequently, the third modification enables the ink which flows from each vertical passage 67*a*-67*d* to uniformly flow into the two sections of each horizontal passage 66*a*-66*d*.

In the third modification, when focusing on each of the protrusions 131*a*-131*d*, the shift amount of the tip of the protrusion in the right-left direction increases with an increase in the distance between the center of the horizontal passage and the connected position at which the vertical passage is connected to the horizontal passage. Thus, the third modification enables the ink which flows from each vertical passage 67*a*-67*d* to uniformly flow into the two sections of each horizontal passage 66*a*-66*d*.

Also in the third modification, the ratio [D11:D12] of the distance between the tip of the protrusion 131*a* and the right end of the vertical passage 67*a* and the distance between the tip of the protrusion 131*a* and the left end of the vertical passage 67*a* is substantially equal to the ratio [L11:L12] of the lengths of the two sections 66*a*1, 66*a*2. This is true of the tip of each protrusion 131*b*-131*d* in the right-left direction. Consequently, the liquid uniformly flows in the two sections of each horizontal passage 66*a*-66*d*.

In the third modification, the shape of each protrusion 131*a*-131*d* projected onto the plane orthogonal to the front-rear direction is symmetrical with respect to the straight line which passes the tip and which is parallel to the up-down direction. This simplifies easy formation of the protrusions 131*a*-131*d*.

In the third modification, all of the protrusions 131*a*-131*d* have the same shape. The protrusions 131*a*-131*d* may have mutually different shapes each of which is symmetrical with respect to the plane which is orthogonal to the right-left direction and on which the tip exists. For instance, the length in the right-left direction and the height may differ among the protrusions 131*a*-131*d*.

In the illustrated embodiment, the head chip 21 includes the four nozzle rows 9, and the four horizontal passages 66*a*-66*d* and the four vertical passages 67*a*-67*d* are provided in the supply unit 22. This is not necessarily required. The head chip 21 may include one through three nozzle rows 9 or five or more nozzle rows 9, and the same number of the horizontal passages and the vertical passages as the number of the nozzle rows 9 in the head chip 21 may be provided in the supply unit 22.

In the illustrated embodiment, the horizontal passage 66*a* connected to the vertical passage 67*a* is a passage extending in the right-left direction, and the two sections 66*a*1, 66*a*2 are passages which extend in mutually opposite sides in the right-left direction from the connected position at which the vertical passage 67*a* is connected to the horizontal passage 66*a*. This is not necessarily required. Instead of the horizontal passage 66*a*, there may be provided an ink passage (as one example of "second flow passage") including two sections that extend from the connected position in mutually different directions which are not parallel to each other. Similarly, instead of each of the horizontal passages 66*b*-66*d* connected to the respective vertical passages 67*b*-67*d*, there may be provided an ink passage (as one example of "second flow passage") including two sections that extend mutually different directions which are not parallel to each other from the connected position with the corresponding vertical passage 67*b*-67*d*.

In this instance, for ensuring easy ink flow, the protrusion is provided for one (as one example of "first section") of the two sections of the ink passage connected to the vertical passage 67*a*-67*d*, which one section has a larger liquid flow resistance.

In the illustrated embodiment, the ink is supplied from the vertical passages 67*a*-67*d* extending in the up-down direction into the horizontal passages 66*a*-66*d*. This is not necessarily required. Instead of the vertical passages 67*a*-67*d*, there may be provided ink passages (each as one example of "first flow passage") extending in a direction different from the up-down direction, and the ink may be supplied from the ink passages to the horizontal passages 66*a*-66*d*.

Figure 10:
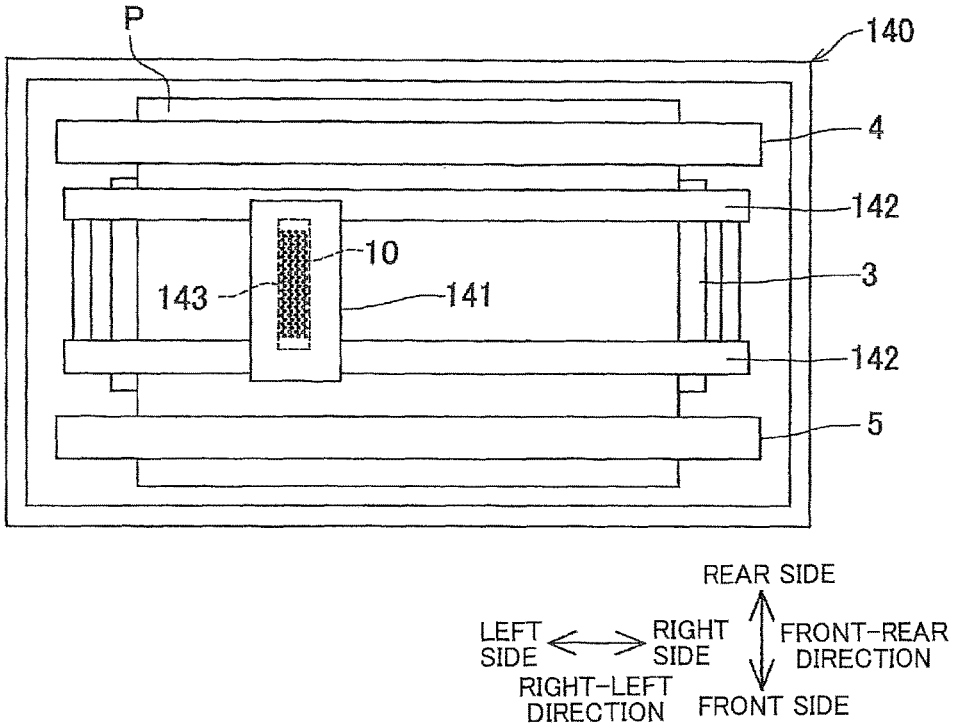
FIG. 10 is a schematic view of a printer 140 according to a fourth modification.

In the illustrated embodiment and the modifications, the present disclosure is applied to the ink-jet printer equipped with the so-called line head. The present disclosure is not limited to this configuration. In a printer 140 according to a fourth modification shown in FIG. 10, a carriage 141 is supported by two guide rails 142 extending in the right-left direction, so as to be movable in the right-left direction. A head unit 143 (as one example of "liquid ejection head") is mounted on the carriage 141. The head unit 143 is similar in construction to the head unit 11 and is disposed such that the arrangement direction of the nozzles 10 coincides with the front-rear direction. That is, the printer 140 is an ink-jet printer equipped with the so-called serial head. The printer 140 includes the platen 3 and the conveyance rollers 4, 5 similar to those of the printer 1. In the printer 140, the head unit 143 configured to move in the right-left direction together with the carriage 141 ejects the ink onto the recording sheet P while the sheet P is being conveyed by the conveyance rollers 4, 5 toward the front side, whereby printing is performed. In the printer 140, the orientations of the flow passages in the head unit 143 and the orientations of the protrusions 65*a*-65*d* are turned on the horizontal plane by 90° from the orientations of those in the illustrated embodiment. In this instance, the front-rear direction is one example of "second direction".

While the present disclosure is applied to the ink-jet head configured to perform printing by ejecting the ink from the nozzles, the present disclosure is not limited to this configuration. For instance, the disclosure may be applied to other liquid ejection heads configured to eject, from the nozzles, a liquid other that than the ink.

What is claimed is:

1. A liquid ejection head, comprising:

a plurality of nozzles; and a supply passage through which a liquid is supplied to the nozzles, wherein the supply passage includes a first flow passage, and a second flow passage connected to the first flow passage and including two sections that extend in mutually different directions from a connected position at which the first flow passage is connected to the second flow passage, the liquid being supplied to the second flow passage from the first flow passage, wherein the second flow passage has a liquid flow resistance larger in a first section as one of the two sections than in a second section as the other of the two sections, wherein a protrusion protruding toward the first flow passage is provided on an inner wall surface of the second flow passage facing the first flow passage, wherein the first flow passage is parallel to a first direction, wherein the first section and the second section of the second flow passage are parallel to a second direction orthogonal to the first direction and extend from the connected position toward mutually opposite directions in the second direction, and wherein a tip of the protrusion is shifted toward the second section from a center of the first flow passage in the second direction.

2. The liquid ejection head according to claim 1, wherein the protrusion has different shapes between a first-section facing portion, of the protrusion, facing the first section and a second-section facing portion, of the protrusion, facing the second section.

3. The liquid ejection head according to claim 2, wherein the protrusion is asymmetrical in the second direction with respect to a plane which is orthogonal to the second direction and on which the tip of the protrusion exists.

4. The liquid ejection head according to claim 3, wherein the first-section facing portion of the protrusion has a smaller inclination angle with respect to the second direction than the second-section facing portion of the protrusion.

5. The liquid ejection head according to claim 1, wherein the tip of the protrusion is located at a position in the second direction in accordance with a ratio of the liquid flow resistance between the first section and the second section of the second flow passage.

6. The liquid ejection head according to claim 5, wherein the tip of the protrusion is disposed at a position in the second direction at which a ratio of a distance between a portion of the first flow passage located on one of opposite sides of the tip of the protrusion on which the first section is located and a portion of the first flow passage located on the other of the opposite sides of the tip of the protrusion on which the second section is located is substantially the same as a ratio of the liquid flow resistance between the first section and the second section.

7. The liquid ejection head according to claim 1, wherein the protrusion is symmetrical in the second direction with respect to a plane which is orthogonal to the second direction and on which the tip of the protrusion exists.

8. The liquid ejection head according to claim 7, wherein the tip of the protrusion is located at a position in the second direction in accordance with a ratio of the liquid flow resistance between the first section and the second section of the second flow passage.

9. The liquid ejection head according to claim 8, wherein the tip of the protrusion is disposed at a position in the second direction at which a ratio of a distance between a portion of the first flow passage located on one of opposite sides of the tip of the protrusion on which the first section is located and a portion of the first flow passage located on the other of the opposite sides of the tip of the protrusion on which the second section is located is substantially the same as a ratio of the liquid flow resistance between the first section and the second section.

10. The liquid ejection head according to claim 1, comprising: a plurality of first flow passages, each as the first flow passage, which are disposed so as to be shifted from one another in the second direction; and a plurality of second flow passages, each as the second flow passage, which are arranged in a third direction orthogonal to both of the first direction and the second direction, the second flow passages being connected respectively to the first flow passages, wherein the second flow passages have respective protrusions, each as the protrusion, which have mutually different shapes.

11. The liquid ejection head according to claim 10, wherein the protrusion has different shapes between a first-section facing portion, of the protrusion, facing the first section and its second-section facing portion, of the protrusion, facing the second section, wherein the first-section facing portion of each of the protrusions has an inclination angle with respect to the second direction smaller than the second-section facing portion thereof, wherein one of the second flow passages is connected to a corresponding one of the first flow passages at a position more distant from a center of the one of the second flow passages in the second direction than another one of the second flow passages, and wherein a difference in the inclination angle between the first-section facing portion and the second-section facing portion of the protrusion provided in the one of the second flow passages is larger than that of the protrusion provided in said another one of the second flow passages.

12. The liquid ejection head according to claim 11, wherein, when focusing on each of the plurality of second flow passages, the difference in the inclination angle between the first-section facing portion and the second-section facing portion of the protrusion increases with an increase in a distance in the second direction between the center of the second flow passage and the connected position at which the first flow passage is connected to the second flow passage.

13. The liquid ejection head according to claim 10, wherein one of the second flow passages is connected to a corresponding one of the first flow passages at a position nearer to a center of the one of the second flow passages in the second direction than another one of the second flow passages, and wherein the protrusion provided in the one of the second flow passages has a dimension in the second direction larger than that of the protrusion provided in said another one of the second flow passages.

14. The liquid ejection head according to claim 13, wherein, when focusing on each of the plurality of second flow passages, the dimension of the protrusion in the second direction increases with a decrease in a distance in the second direction between the center of the second flow passage and the connected position at which the first flow passage is connected to the second flow passage.

15. The liquid ejection head according to claim 10, wherein one of the second flow passages is connected to a corresponding one of the first flow passages at a position nearer to a center of the one of the second flow passages in the second direction than another one of the second flow passages, and wherein the protrusion provided in the one of the second flow passages has a dimension in the first direction larger than that of the protrusion provided in said another one of the second flow passages.

16. The liquid ejection head according to claim 15, wherein, when focusing on each of the plurality of second flow passages, the dimension of the protrusion in the first direction increases with a decrease in a distance in the second direction between the center of the second flow passages and the connected position at which the first flow passages is connected to the second flow passage.

17. The liquid ejection head according to claim 10, wherein one of the second flow passages is connected to a corresponding one of the first flow passages at a position more distant from a center of the one of the second flow passages in the second direction than another one of the second flow passages, and wherein the one of the second flow passages has a cross sectional area at a portion thereof at which the protrusion is provided larger than that of said another one of the second flow passages.

18. The liquid ejection head according to claim 17, wherein, when focusing on each of the plurality of second flow passages, the cross sectional area increases with an increase in a distance in the second direction between the center of the second flow passage and the connected position at which the first flow passages is connected to the second flow passage.

19. A liquid ejection head, comprising:

a plurality of nozzles; and a supply passage through which a liquid is supplied to the nozzles, wherein the supply passage includes a first flow passage, and a second flow passage connected to the first flow passage and including two sections that extend in mutually different directions from a connected position at which the first flow passage is connected to the second flow passage, the liquid being supplied to the second flow passage from the first flow passage, wherein the second flow passage has a liquid flow resistance larger in a first section as one of the two sections than in a second section as the other of the two sections, wherein a protrusion protruding toward the first flow passage is provided on an inner wall surface of the second flow passage facing the first flow passage, wherein the first flow passage is parallel to a first direction, wherein the first section and the second section of the second flow passage are parallel to a second direction orthogonal to the first direction and extend from the connected position toward mutually opposite directions in the second direction, and wherein the protrusion is asymmetrical in the second direction with respect to a plane which is orthogonal to the second direction and on which a tip of the protrusion exists.

20. A liquid ejection head, comprising:

a plurality of nozzles; and a supply passage through which a liquid is supplied to the nozzles, wherein the supply passage includes a first flow passage, and a second flow passage connected to the first flow passage and including two sections that extend in mutually different directions from a connected position at which the first flow passage is connected to the second flow passage, the liquid being supplied to the second flow passage from the first flow passage, wherein the second flow passage has a liquid flow resistance larger in a first section as one of the two sections than in a second section as the other of the two sections, wherein a protrusion protruding toward the first flow passage is provided on an inner wall surface of the second flow passage facing the first flow passage, wherein the liquid ejection head comprises a plurality of first flow passages, each as the first flow passage, which are disposed so as to be shifted from one another in the second direction; and a plurality of second flow passages, each as the second flow passage, which are arranged in a third direction orthogonal to both of the first direction and the second direction, the second flow passages being connected respectively to the first flow passages, and wherein the second flow passages have respective protrusions, each as the protrusion, which have mutually different shapes.

* * * * *